US009423152B2

(12) United States Patent
Ampolini et al.

(10) Patent No.: US 9,423,152 B2
(45) Date of Patent: Aug. 23, 2016

(54) HEATING CONTROL ARRANGEMENT FOR AN ELECTRONIC SMOKING ARTICLE AND ASSOCIATED SYSTEM AND METHOD

(71) Applicant: R. J. REYNOLDS TOBACCO COMPANY, Winston-Salem, NC (US)

(72) Inventors: Frederic Philippe Ampolini, Winston-Salem, NC (US); Michael Ryan Galloway, Winston-Salem, NC (US); Scott Ingham, Wake Forest, NC (US); Allen Michael East, Cary, NC (US); Glen Kimsey, Cary, NC (US); Keith William Anderson, Hillsborough, NC (US); Raymond C. Henry, Jr., Cary, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 440 days.

(21) Appl. No.: 13/837,542

(22) Filed: Mar. 15, 2013

(65) Prior Publication Data

US 2014/0270727 A1 Sep. 18, 2014

(51) Int. Cl.

| | |
|---|---|
| ***A01M 13/00*** | (2006.01) |
| ***F22B 1/20*** | (2006.01) |
| ***F24H 9/00*** | (2006.01) |
| ***A24F 47/00*** | (2006.01) |

(52) U.S. Cl.

CPC ..... *F24H 9/0005* (2013.01); *A24F 47/008* (2013.01)

(58) Field of Classification Search

None

See application file for complete search history.

(56) References Cited

U.S. PATENT DOCUMENTS

| | | | |
|---|---|---|---|
| 1,771,366 | A | 7/1930 | Wyss et al. |
| 2,057,353 | A | 10/1936 | Whittemore, Jr. |
| 2,104,266 | A | 1/1938 | McCormick |
| 2,805,669 | A | 9/1957 | Meriro |
| 3,200,819 | A | 8/1965 | Gilbert |
| 3,316,919 | A | 5/1967 | Green et al. |
| 3,398,754 | A | 8/1968 | Tughan |
| 3,419,015 | A | 12/1968 | Wochnowski |
| 3,424,171 | A | 1/1969 | Rooker |
| 3,476,118 | A | 11/1969 | Luttich |
| 4,054,145 | A | 10/1977 | Berndt et al. |
| 4,131,117 | A | 12/1978 | Kite et al. |

(Continued)

FOREIGN PATENT DOCUMENTS

| | | |
|---|---|---|
| AU | 276250 | 7/1965 |
| CA | 2 641 869 | 5/2010 |

(Continued)

*Primary Examiner* — Thor Campbell

(74) *Attorney, Agent, or Firm* — Womble, Carlyle, Sandridge & Rice, LLP

(57) ABSTRACT

A method is provided for controlling heating of an aerosol precursor arrangement of an electronic smoking article. An average power is directed from a power source to a heating device arranged to heat the aerosol precursor arrangement and a heating time period commensurately initiated. The average power corresponds to a selected power set point associated with the power source. An actual power directed to the heating device is determined as a product of a voltage at, and a current through, the heating device. The actual power is compared to the average power, and the average power is adjusted to direct the actual power toward the selected power set point. The actual power is periodically determined and compared to the average power, and the average power adjusted toward the selected power set point, until expiration of the heating time period. An associated apparatus and computer program product are also provided.

36 Claims, 10 Drawing Sheets

(56) References Cited

U.S. PATENT DOCUMENTS 4,150,677 A 4/1979 Osborne
4,190,046 A 2/1980 Virag
4,219,032 A 8/1980 Tabatznik et al.
4,259,970 A 4/1981 Green, Jr.
4,284,089 A 8/1981 Ray
4,303,083 A 12/1981 Burruss, Jr.
4,449,541 A 5/1984 Mays et al.
4,506,682 A 3/1985 Muller
4,635,651 A 1/1987 Jacobs
4,674,519 A 6/1987 Keritsis et al.
4,708,151 A 11/1987 Shelar
4,714,082 A 12/1987 Banerjee et al.
4,735,217 A 4/1988 Gerth et al.
4,756,318 A 7/1988 Clearman et al.
4,771,795 A 9/1988 White et al.
4,776,353 A 10/1988 Lilja et al.
4,793,365 A 12/1988 Sensabaugh, Jr. et al.
4,800,903 A 1/1989 Ray et al.
4,819,665 A 4/1989 Roberts et al.
4,821,749 A 4/1989 Toft et al.
4,830,028 A 5/1989 Lawson et al.
4,836,224 A 6/1989 Lawson et al.
4,836,225 A 6/1989 Sudoh
4,848,374 A 7/1989 Chard et al.
4,848,376 A 7/1989 Lilja et al.
4,874,000 A 10/1989 Tamol et al.
4,880,018 A 11/1989 Graves, Jr. et al.
4,887,619 A 12/1989 Burcham, Jr. et al.
4,907,606 A 3/1990 Lilja et al.
4,913,168 A 4/1990 Potter et al.
4,917,119 A 4/1990 Potter et al.
4,917,128 A 4/1990 Clearman et al.
4,922,901 A 5/1990 Brooks et al.
4,924,888 A 5/1990 Perfetti et al.
4,928,714 A 5/1990 Shannon
4,938,236 A 7/1990 Banerjee et al.
4,941,483 A 7/1990 Ridings et al.
4,941,484 A 7/1990 Clapp et al.
4,945,931 A 8/1990 Gori
4,947,874 A 8/1990 Brooks et al.
4,947,875 A 8/1990 Brooks et al.
4,972,854 A 11/1990 Kiernan et al.
4,972,855 A 11/1990 Kuriyama et al.
4,986,286 A 1/1991 Roberts et al.
4,987,906 A 1/1991 Young et al.
5,005,593 A 4/1991 Fagg
5,019,122 A 5/1991 Clearman et al.
5,022,416 A 6/1991 Watson
5,036,181 A * 7/1991 Fishman ..... F27D 19/00 219/497
5,042,510 A 8/1991 Curtiss et al.
5,056,537 A 10/1991 Brown et al.
5,060,669 A 10/1991 White et al.
5,060,671 A 10/1991 Counts et al.
5,065,775 A 11/1991 Fagg
5,072,744 A 12/1991 Luke et al.
5,074,319 A 12/1991 White et al.
5,076,296 A 12/1991 Nystrom et al.
5,093,894 A 3/1992 Deevi et al.
5,095,921 A 3/1992 Losee et al.
5,097,850 A 3/1992 Braunshteyn et al.
5,099,862 A 3/1992 White et al.
5,099,864 A 3/1992 Young et al.
5,103,842 A 4/1992 Strang et al.
5,121,757 A 6/1992 White et al.
5,129,409 A 7/1992 White et al.
5,131,415 A 7/1992 Munoz et al.
5,143,097 A 9/1992 Sohn et al.
5,144,962 A 9/1992 Counts et al.
5,146,934 A 9/1992 Deevi et al.
5,159,940 A 11/1992 Hayward et al.
5,159,942 A 11/1992 Brinkley et al.
5,179,966 A 1/1993 Losee et al.
5,211,684 A 5/1993 Shannon et al.
5,220,930 A 6/1993 Gentry
5,224,498 A 7/1993 Deevi et al.
5,228,460 A 7/1993 Sprinkel, Jr. et al.
5,230,354 A 7/1993 Smith et al.
5,235,992 A 8/1993 Sensabaugh
5,243,999 A 9/1993 Smith
5,246,018 A 9/1993 Deevi et al.
5,249,586 A 10/1993 Morgan et al.
5,261,424 A 11/1993 Sprinkel, Jr.
5,269,327 A 12/1993 Counts et al.
5,285,798 A 2/1994 Banerjee et al.
5,293,883 A 3/1994 Edwards
5,301,694 A 4/1994 Raymond
5,303,720 A 4/1994 Banerjee et al.
5,318,050 A 6/1994 Gonzalez-Parra et al.
5,322,075 A 6/1994 Deevi et al.
5,322,076 A 6/1994 Brinkley et al.
5,339,838 A 8/1994 Young et al.
5,345,951 A 9/1994 Serrano et al.
5,353,813 A 10/1994 Deevi et al.
5,357,984 A 10/1994 Farrier et al.
5,360,023 A 11/1994 Blakley et al.
5,369,723 A 11/1994 Counts et al.
5,372,148 A 12/1994 McCafferty et al.
5,377,698 A 1/1995 Litzinger et al.
5,388,574 A 2/1995 Ingebrethsen et al.
5,388,594 A 2/1995 Counts et al.
5,408,574 A 4/1995 Deevi et al.
5,435,325 A 7/1995 Clapp et al.
5,445,169 A 8/1995 Brinkley et al.
5,468,266 A 11/1995 Bensalem et al.
5,468,936 A 11/1995 Deevi et al.
5,479,948 A 1/1996 Counts et al.
5,498,850 A 3/1996 Das
5,498,855 A 3/1996 Deevi et al.
5,499,636 A 3/1996 Baggett, Jr. et al.
5,501,237 A 3/1996 Young et al.
5,505,214 A 4/1996 Collins et al.
5,515,842 A 5/1996 Ramseyer et al.
5,530,225 A 6/1996 Hajaligol
5,551,450 A 9/1996 Hemsley
5,551,451 A 9/1996 Riggs et al.
5,564,442 A 10/1996 MacDonald et al.
5,573,692 A 11/1996 Das et al.
5,591,368 A 1/1997 Fleischhauer et al.
5,593,792 A 1/1997 Farrier et al.
5,595,577 A 1/1997 Bensalem et al.
5,596,706 A 1/1997 Sikk et al.
5,611,360 A 3/1997 Tang
5,613,504 A 3/1997 Collins et al.
5,613,505 A 3/1997 Campbell et al.
5,649,552 A 7/1997 Cho et al.
5,649,554 A 7/1997 Sprinkel et al.
5,659,656 A 8/1997 Das
5,665,262 A 9/1997 Hajaligol et al.
5,666,976 A 9/1997 Adams et al.
5,666,977 A 9/1997 Higgins et al.
5,666,978 A 9/1997 Counts et al.
5,692,525 A 12/1997 Counts et al.
5,692,526 A 12/1997 Adams et al.
5,708,258 A 1/1998 Counts et al.
5,711,320 A 1/1998 Martin
5,726,421 A 3/1998 Fleischhauer et al.
5,727,571 A 3/1998 Meiring et al.
5,730,158 A 3/1998 Collins et al.
5,750,964 A 5/1998 Counts et al.
5,799,663 A 9/1998 Gross et al.
5,816,263 A 10/1998 Counts et al.
5,819,756 A 10/1998 Mielordt
5,829,453 A 11/1998 White et al.
5,865,185 A 2/1999 Collins et al.
5,865,186 A 2/1999 Volsey, II
5,878,752 A 3/1999 Adams et al.
5,880,439 A 3/1999 Deevi et al.
5,915,387 A 6/1999 Baggett, Jr. et al.
5,934,289 A 8/1999 Watkins et al.
5,954,979 A 9/1999 Counts et al.
5,967,148 A 10/1999 Harris et al.
6,026,820 A 2/2000 Baggett, Jr. et al.
6,033,623 A 3/2000 Deevi et al.

(56) References Cited

U.S. PATENT DOCUMENTS 6,040,560 A * 3/2000 Fleischhauer ..... A24F 47/008 128/202.21
6,053,176 A 4/2000 Adams et al.
6,089,857 A 7/2000 Matsuura et al.
6,095,153 A 8/2000 Kessler et al.
6,116,247 A 9/2000 Banyasz et al.
6,119,700 A 9/2000 Fleischhauer et al.
6,125,853 A 10/2000 Susa et al.
6,125,855 A 10/2000 Nevett et al.
6,125,866 A 10/2000 Nichols et al.
6,155,268 A 12/2000 Takeuchi
6,164,287 A 12/2000 White
6,182,670 B1 2/2001 White
6,196,218 B1 3/2001 Voges
6,196,219 B1 3/2001 Hess et al.
6,216,706 B1 4/2001 Kumar et al.
6,289,898 B1 9/2001 Fournier et al.
6,349,728 B1 2/2002 Pham
6,357,671 B1 3/2002 Cewers
6,418,938 B1 7/2002 Fleischhauer et al.
6,446,426 B1 9/2002 Sweeney et al.
6,532,965 B1 3/2003 Abhulimen et al.
6,598,607 B2 7/2003 Adiga et al.
6,601,776 B1 8/2003 Oljaca et al.
6,615,840 B1 9/2003 Fournier et al.
6,688,313 B2 2/2004 Wrenn et al.
6,701,936 B2 3/2004 Shafer et al.
6,715,494 B1 4/2004 McCoy
6,730,832 B1 5/2004 Dominguez et al.
6,772,756 B2 8/2004 Shayan
6,803,545 B2 10/2004 Blake et al.
6,803,550 B2 10/2004 Sharpe et al.
6,810,883 B2 11/2004 Felter et al.
6,854,461 B2 2/2005 Nichols
6,854,470 B1 2/2005 Pu
6,994,096 B2 2/2006 Rostami et al.
7,011,096 B2 3/2006 Li et al.
7,017,585 B2 3/2006 Li et al.
7,025,066 B2 4/2006 Lawson et al.
7,040,314 B2 5/2006 Nguyen et al.
7,117,867 B2 10/2006 Cox et al.
7,163,015 B2 1/2007 Moffitt
7,173,222 B2 2/2007 Cox et al.
7,185,659 B2 3/2007 Sharpe et al.
7,234,470 B2 6/2007 Yang
7,290,549 B2 11/2007 Banerjee et al.
7,293,565 B2 11/2007 Griffin et al.
7,392,809 B2 7/2008 Larson et al.
7,513,253 B2 4/2009 Kobayashi et al.
7,647,932 B2 1/2010 Cantrell et al.
7,690,385 B2 4/2010 Moffitt
7,692,123 B2 4/2010 Baba et al.
7,726,320 B2 6/2010 Robinson et al.
7,775,459 B2 8/2010 Martens, III et al.
7,810,505 B2 10/2010 Yang
7,832,410 B2 11/2010 Hon
7,845,359 B2 12/2010 Montaser
7,878,209 B2 2/2011 Newbery et al.
7,896,006 B2 3/2011 Hamano et al.
8,066,010 B2 11/2011 Newbery et al.
8,079,371 B2 12/2011 Robinson et al.
8,127,772 B2 3/2012 Montaser
8,156,944 B2 4/2012 Han
8,365,742 B2 2/2013 Hon
8,375,957 B2 2/2013 Hon
8,393,331 B2 3/2013 Hon
2002/0146242 A1 10/2002 Vieira
2003/0131859 A1 7/2003 Li et al.
2003/0226837 A1 12/2003 Blake et al.
2004/0020500 A1 2/2004 Wrenn et al.
2004/0129280 A1 7/2004 Woodson et al.
2004/0149296 A1 8/2004 Rostami et al.
2004/0200488 A1 10/2004 Felter et al.
2004/0224435 A1 11/2004 Shibata et al.
2004/0226568 A1 11/2004 Takeuchi et al.
2004/0255965 A1 12/2004 Perfetti et al.
2005/0016549 A1 1/2005 Banerjee et al.
2005/0016550 A1 1/2005 Katase
2005/0066986 A1 3/2005 Nestor et al.
2005/0151126 A1 7/2005 Yamakawa et al.
2005/0172976 A1 8/2005 Newman et al.
2005/0274390 A1 12/2005 Banerjee et al.
2006/0016453 A1 1/2006 Kim
2006/0032501 A1 2/2006 Hale et al.
2006/0070633 A1 4/2006 Rostami et al.
2006/0162733 A1 7/2006 McGrath et al.
2006/0185687 A1 8/2006 Hearn et al.
2006/0196518 A1 9/2006 Hon
2007/0074734 A1 4/2007 Braunshteyn et al.
2007/0102013 A1 5/2007 Adams et al.
2007/0215167 A1 9/2007 Crooks et al.
2007/0283972 A1 12/2007 Monsees et al.
2008/0092912 A1 4/2008 Robinson et al.
2008/0149118 A1 6/2008 Oglesby et al.
2008/0245377 A1 10/2008 Marshall et al.
2008/0257367 A1 10/2008 Paterno et al.
2008/0276947 A1 11/2008 Martzel
2008/0302374 A1 12/2008 Wengert et al.
2009/0065010 A1 3/2009 Shands
2009/0095311 A1 4/2009 Hon
2009/0095312 A1 4/2009 Herbrich et al.
2009/0126745 A1 5/2009 Hon
2009/0188490 A1 7/2009 Hon
2009/0230117 A1 9/2009 Fernando et al.
2009/0260641 A1 10/2009 Monsees et al.
2009/0260642 A1 10/2009 Monsees et al.
2009/0272379 A1 11/2009 Thorens et al.
2009/0283103 A1 11/2009 Nielsen et al.
2009/0288668 A1 11/2009 Inagaki
2009/0293892 A1 12/2009 Williams et al.
2009/0320863 A1 12/2009 Fernando et al.
2009/0324206 A1 12/2009 Young et al.
2010/0006113 A1 1/2010 Urtsev et al.
2010/0024834 A1 2/2010 Oglesby et al.
2010/0028766 A1 2/2010 Peckerar et al.
2010/0043809 A1 2/2010 Magnon
2010/0059070 A1 3/2010 Potter et al.
2010/0059073 A1 3/2010 Hoffmann et al.
2010/0065075 A1 3/2010 Banerjee et al.
2010/0083959 A1 4/2010 Siller
2010/0163063 A1 7/2010 Fernando et al.
2010/0200006 A1 8/2010 Robinson et al.
2010/0229881 A1 9/2010 Hearn
2010/0242974 A1 9/2010 Pan
2010/0242976 A1 9/2010 Katayama et al.
2010/0258139 A1 10/2010 Onishi et al.
2010/0300467 A1 12/2010 Kuistilla et al.
2010/0307518 A1 12/2010 Wang
2010/0313901 A1 12/2010 Fernando et al.
2011/0005535 A1 1/2011 Xiu
2011/0011396 A1 1/2011 Fang
2011/0036363 A1 2/2011 Urtsev et al.
2011/0036365 A1 2/2011 Chong et al.
2011/0073121 A1 3/2011 Levin et al.
2011/0088707 A1 4/2011 Hajaligol
2011/0094523 A1 4/2011 Thorens et al.
2011/0120480 A1 5/2011 Gedevanishvili et al.
2011/0126848 A1 6/2011 Zuber et al.
2011/0155153 A1 6/2011 Thorens et al.
2011/0155718 A1 6/2011 Greim et al.
2011/0162663 A1 7/2011 Bryman
2011/0168194 A1 7/2011 Hon
2011/0180082 A1 7/2011 Banerjee et al.
2011/0265806 A1 11/2011 Alarcon et al.
2011/0309157 A1 12/2011 Yang et al.
2012/0042885 A1 2/2012 Stone et al.
2012/0060853 A1 3/2012 Robinson et al.
2012/0111347 A1 5/2012 Hon
2012/0132643 A1 5/2012 Choi et al.
2012/0231464 A1 9/2012 Yu et al.
2012/0279512 A1 11/2012 Hon
2012/0318882 A1 12/2012 Abehasera
2013/0081642 A1 4/2013 Safari
2013/0104916 A1* 5/2013 Bellinger ..... A61M 11/041

(56) References Cited

U.S. PATENT DOCUMENTS

| | | | | |
|---|---|---|---|---|
| | | | | 131/328 |
| 2013/0255702 | A1 | 10/2013 | Griffith, Jr. et al. | |
| 2013/0306084 | A1 | 11/2013 | Flick | |
| 2013/0340775 | A1 | 12/2013 | Juster et al. | |
| 2014/0253144 | A1* | 9/2014 | Novak, III | A24F 47/008 324/550 |
| 2014/0321837 | A1* | 10/2014 | Flick | F24H 1/0018 392/387 |
| 2014/0345606 | A1* | 11/2014 | Talon | A24F 47/008 128/202.21 |
| 2014/0345633 | A1* | 11/2014 | Talon | A24F 47/008 131/329 |
| 2015/0053217 | A1* | 2/2015 | Steingraber | A24F 47/008 131/329 |
| 2015/0165146 | A1* | 6/2015 | Bowman | A61M 16/0069 128/203.14 |
| 2015/0257445 | A1* | 9/2015 | Henry, Jr. | A24F 47/008 131/328 |
| 2015/0258289 | A1* | 9/2015 | Henry, Jr. | A61M 15/06 128/202.21 |

FOREIGN PATENT DOCUMENTS

| | | | |
|---|---|---|---|
| CA | 2 752 255 | | 8/2010 |
| CN | 1541577 | | 11/2004 |
| CN | 2719043 | | 8/2005 |
| CN | 200997909 | | 1/2008 |
| CN | 101116542 | | 2/2008 |
| CN | 101176805 | | 5/2008 |
| CN | 201379072 | | 1/2010 |
| DE | 10 2006 004 484 | | 8/2007 |
| DE | 102006041042 | | 3/2008 |
| DE | 20 2009 010 400 | | 11/2009 |
| EP | 0 295 122 | | 12/1988 |
| EP | 0 430 566 | | 6/1991 |
| EP | 0 845 220 | | 6/1998 |
| EP | 1 618 803 | | 1/2006 |
| EP | 2 110 033 | A1 | 10/2009 |
| EP | 2 316 286 | | 5/2011 |
| EP | 2 468 116 | | 6/2012 |
| GB | 1444461 | | 7/1976 |
| GB | 2469850 | | 11/2010 |
| WO | WO 86/02528 | | 5/1986 |
| WO | WO 97/48293 | | 12/1997 |
| WO | WO 02/37990 | | 5/2002 |
| WO | WO 2004/043175 | | 5/2004 |
| WO | WO 2007/131449 | | 11/2007 |
| WO | WO 2009/105919 | | 9/2009 |
| WO | WO 2009/155734 | | 12/2009 |
| WO | WO 2010/003480 | | 1/2010 |
| WO | WO 2010/045670 | | 4/2010 |
| WO | WO 2010/073122 | | 7/2010 |
| WO | WO 2010/091593 | | 8/2010 |
| WO | WO 2010/118644 | | 10/2010 |
| WO | WO 2010/140937 | | 12/2010 |
| WO | WO 2011/010334 | | 1/2011 |
| WO | WO 2011/081558 | | 7/2011 |
| WO | WO 2012/072762 | | 6/2012 |
| WO | WO 2013/089551 | | 6/2013 |

* cited by examiner

HEATING CONTROL ARRANGEMENT FOR AN ELECTRONIC SMOKING ARTICLE AND ASSOCIATED SYSTEM AND METHOD

BACKGROUND OF THE DISCLOSURE

1. Field of the Disclosure

The present disclosure relates to aerosol delivery articles and uses thereof, and in particular to articles that can be considered to be smoking articles for purposes of yielding components of tobacco and other materials in an inhalable form. Highly preferred components of such articles are made or derived from tobacco, or those articles can be characterized as otherwise incorporating tobacco for human consumption.

2. Description of Related Art

Many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al. and U.S. patent application Ser. No. 13/647,000, filed Oct. 8, 2012, to Sears et al., which are incorporated herein by reference.

Certain tobacco products that have employed electrical energy to produce heat for smoke or aerosol formation, and in particular, certain products that have been referred to as electronic cigarette products, have been commercially available throughout the world. Representative products that resemble many of the attributes of traditional types of cigarettes, cigars or pipes have been marketed as ACCORD® by Philip Morris Incorporated; ALPHA™, JOYE 510™ and M4™ by InnoVapor LLC; CIRRUS™ and FLING™ by White Cloud Cigarettes; COHITA™, COLIBRI™, ELITE CLASSIC™, MAGNUM™, PHANTOM™ and SENSE™ by Epuffer®International Inc.; DUOPRO™, STORM™ and VAPORKING® by Electronic Cigarettes, Inc.; EGAR™ by Egar Australia; eGo-C™ and eGo-T™ by Joyetech; ELUSION™ by Elusion UK Ltd; EONSMOKE® by Eonsmoke LLC; GREEN SMOKE® by Green Smoke Inc. USA; GREENARETTE™ by Greenarette LLC; HALLIGAN™, HENDU™, JET™, MAXXQ™, PINK™ and PITBULL™ by Smoke Stik®; HEATBAR™ by Philip Morris International, Inc.; HYDRO IMPERIAL™ and LXE™ from Crown7; LOGIC™ and THE CUBAN™ by LOGIC Technology; LUCI® by Luciano Smokes Inc.; METRO® by Nicotek, LLC; NJOY® and ONEJOY™ by Sottera, Inc.; NO. 7™ by SS Choice LLC; PREMIUM ELECTRONIC CIGARETTE™ by PremiumEstore LLC; RAPP E-MYSTICK™ by Ruyan America, Inc.; RED DRAGON™ by Red Dragon Products, LLC; RUYAN® by Ruyan Group (Holdings) Ltd.; SMART SMOKER® by The Smart Smoking Electronic Cigarette Company Ltd.; SMOKE ASSIST® by Coastline Products LLC; SMOKING EVERYWHERE® by Smoking Everywhere, Inc.; V2CIGS™ by VMR Products LLC; VAPOR NINE™ by VaporNine LLC; VAPOR4LIFE® by Vapor 4 Life, Inc.; VEPPO™ by E-CigaretteDirect, LLC and VUSE® by R. J. Reynolds Vapor Company. Yet other electrically powered aerosol delivery devices, and in particular those devices that have been characterized as so-called electronic cigarettes, have been marketed under the tradenames BLU™; COOLER VISIONS™; DIRECT E-CIG™; DRAGONFLY™; EMIST™; EVERSMOKE™; GAMUCCI®; HYBRID FLAME™; KNIGHT STICKS™; ROYAL BLUES™; SMOKETIP® and SOUTH BEACH SMOKE™.

It would be desirable to provide a smoking article that employs heat produced by electrical energy to provide the sensations of cigarette, cigar, or pipe smoking, that does so without combusting tobacco to any significant degree, that does so without the need of a combustion heat source, and that does so without necessarily delivering considerable quantities of incomplete combustion and pyrolysis products.

SUMMARY OF THE DISCLOSURE

The above and other needs are addressed by aspects of the present disclosure which, in one aspect, provides a method of controlling heating of an aerosol precursor arrangement of an electronic smoking article. Such a method comprises directing an average power from a power source to a heating device arranged to heat the aerosol precursor arrangement and commensurately initiating a heating time period, wherein the average power corresponds to a selected power set point associated with the power source. An actual power directed to the heating device is determined as a product of a voltage at the heating device and a current through the heating device, and the actual power is compared to the average power. The average power directed to the heating device is adjusted so as to direct the actual power toward the selected power set point. The actual power is periodically determined and compared to the average power, and the average power adjusted to direct the actual power toward the selected power set point, until expiration of the heating time period.

In another aspect of the present disclosure, an apparatus comprising processing circuitry is provided. The processing circuitry of this example embodiment may be configured to control the apparatus to at least perform the steps of the method aspect.

In yet another aspect of the present disclosure, a computer program product is provided comprising at least one non-transitory computer readable storage medium having computer program code stored thereon. The program code of this embodiment may include program code for at least performing the steps of the method aspect upon execution thereof.

Aspects of the present disclosure thus address the identified needs and provide other advantages as otherwise detailed herein. It will be appreciated that the above summary is provided merely for purposes of summarizing some example embodiments so as to provide a basic understanding of some aspects of the disclosure. As such, it will be appreciated that the above described example embodiments are merely examples and should not be construed to narrow the scope or spirit of the disclosure in any way. It will be appreciated that the scope of the disclosure encompasses many potential embodiments, some of which will be further described below, in addition to those here summarized.

BRIEF DESCRIPTION OF THE SEVERAL VIEWS OF THE DRAWING(S)

Having thus described the disclosure in the foregoing general terms, reference will now be made to the accompanying drawings, which are not necessarily drawn to scale, and wherein:

Figure 6:
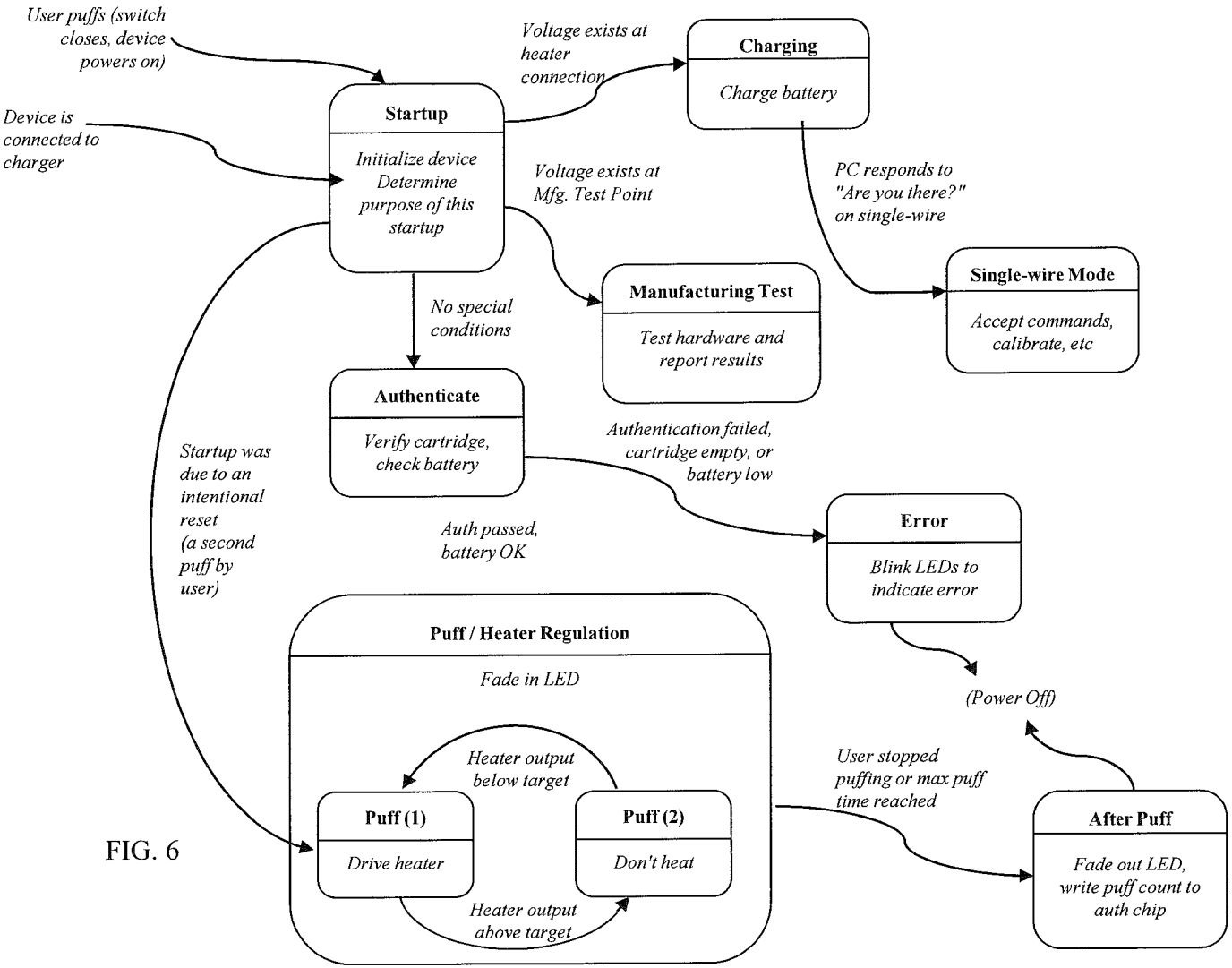
Figure 7:
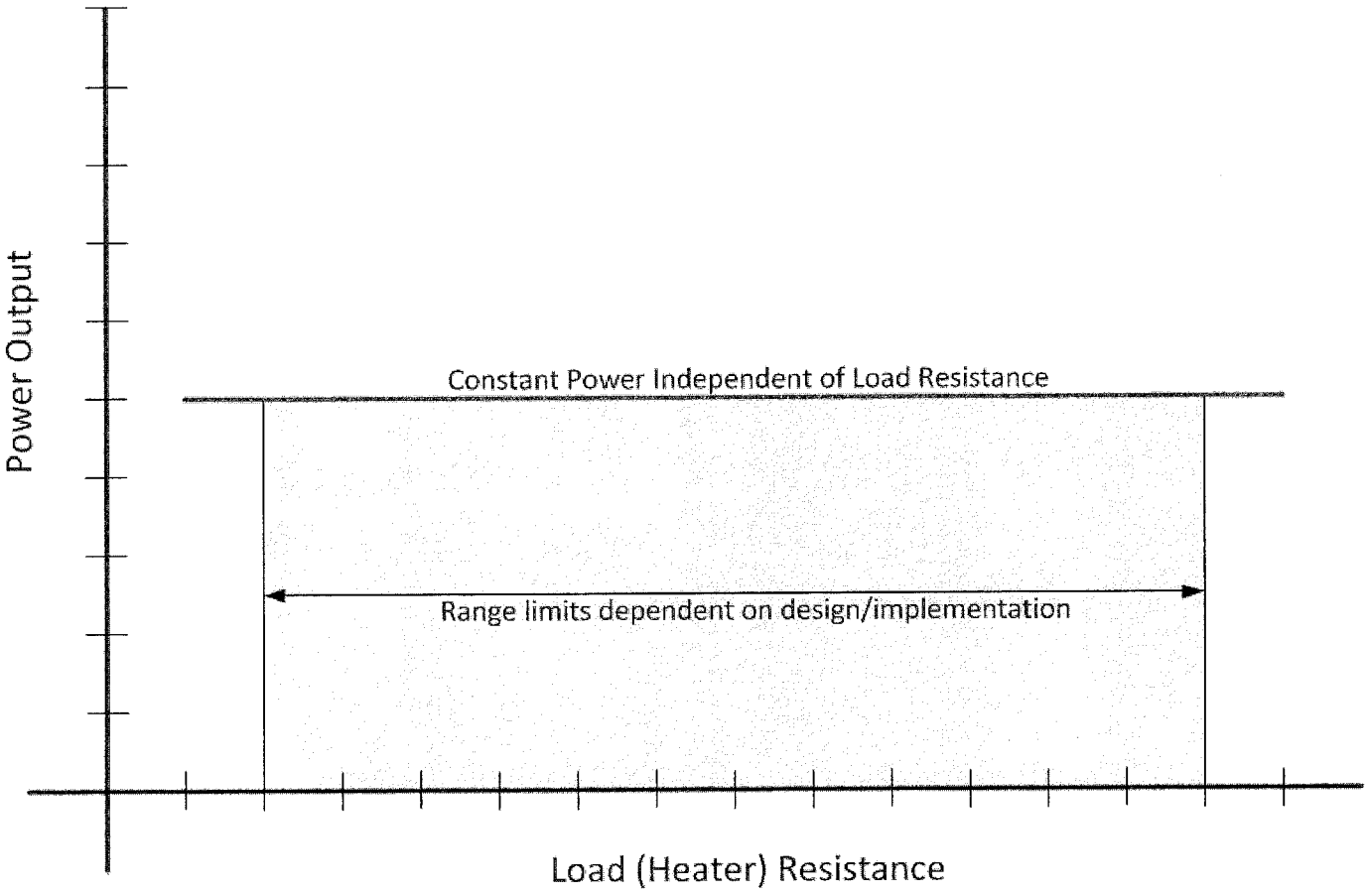
Figure 8:
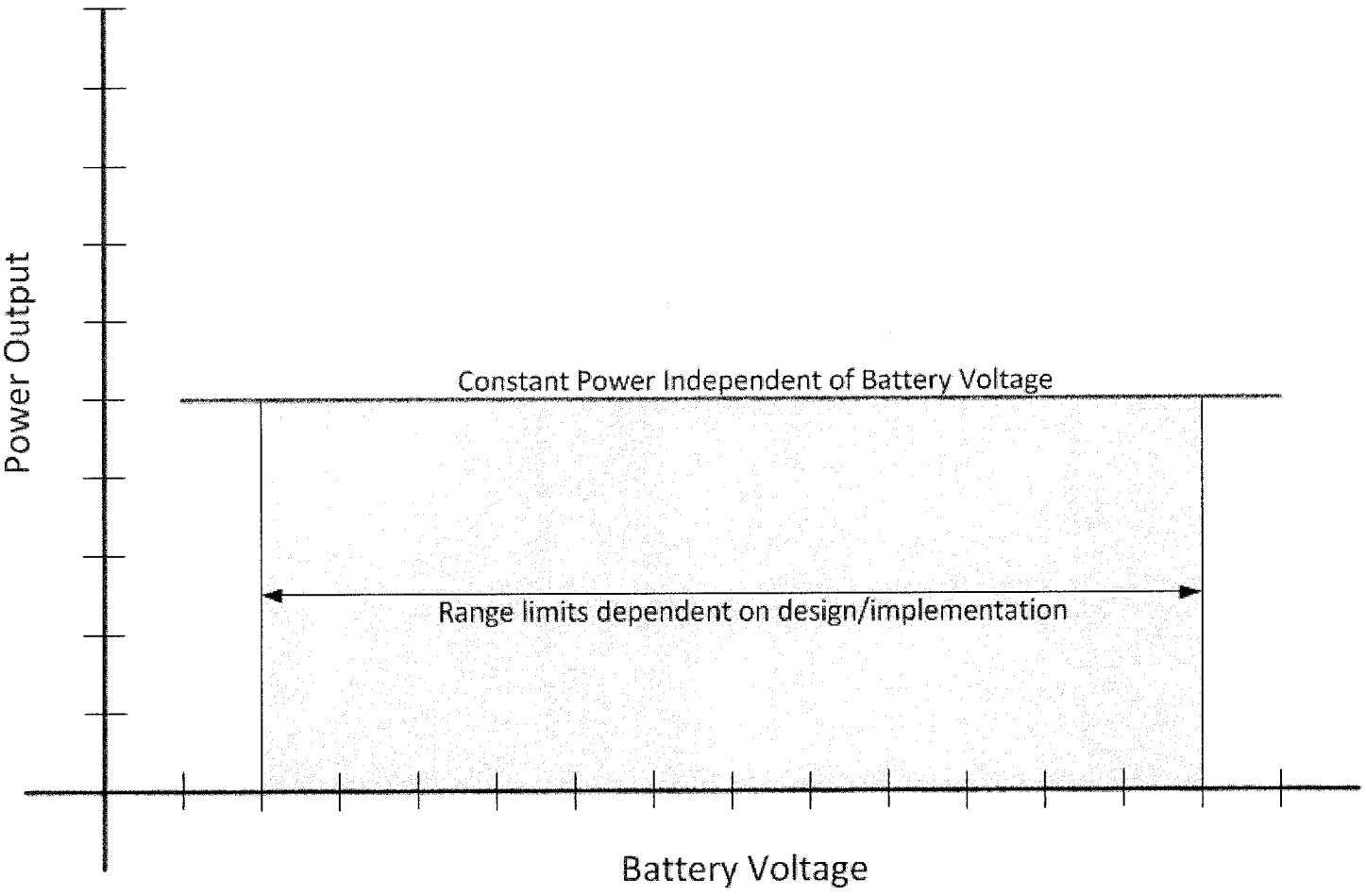
Figure 9:
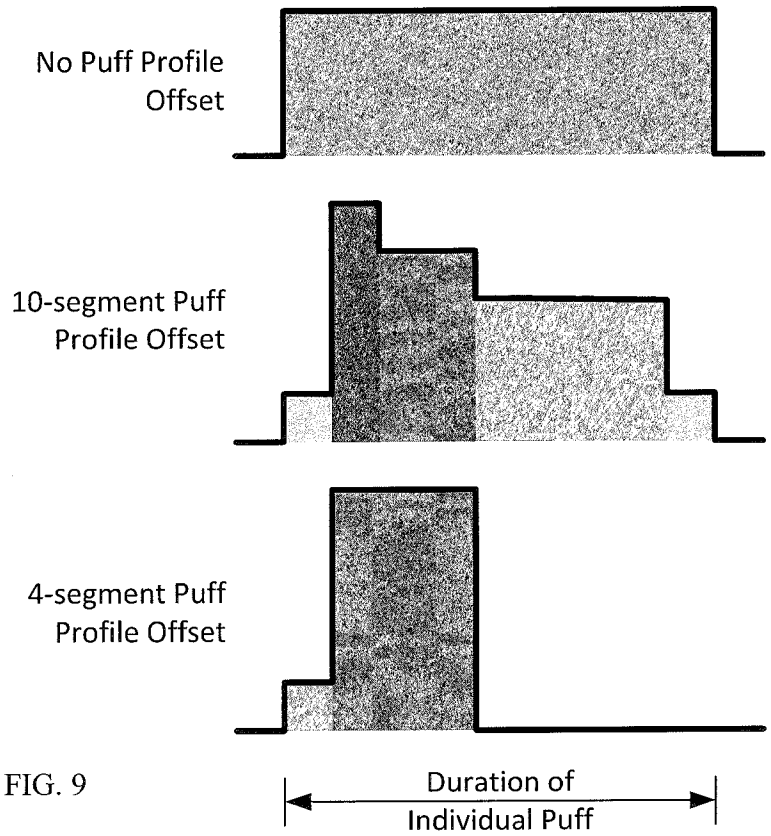
Figure 10:
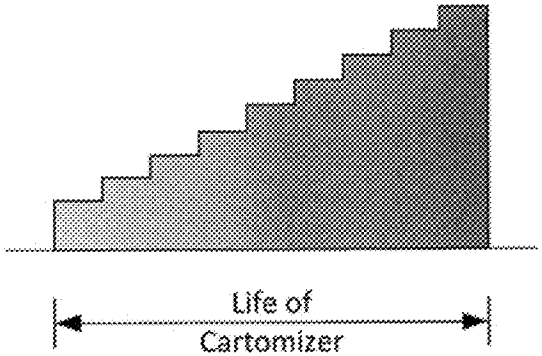
Figure 12:
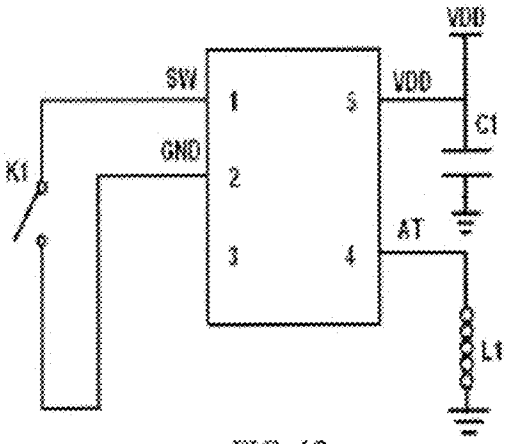
Figure 11:
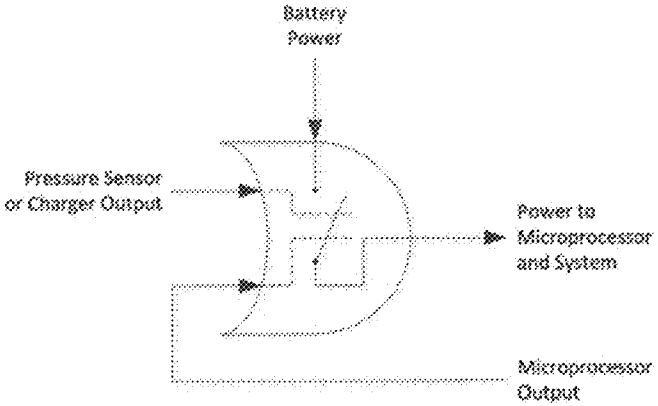

FIG. 6 schematically illustrates a flow diagram of operations/functions of the aspects of the electronic smoking article disclosed herein;

FIG. 7 schematically illustrates an "area of stability" with respect to power control regulation according to various aspects of the present disclosure;

FIG. 8 schematically illustrates a graph of one exemplary sample of power delivered across battery voltage, for an electronic smoking article according to one aspect of the present disclosure;

FIG. 9 schematically illustrates exemplary current/power profiles for the heating component over the duration of a puff, for an electronic smoking article according to one aspect of the present disclosure;

FIG. 10 schematically illustrates different segments of the puff life or the puff count associated with different heating component profiles, for an electronic smoking article according to one aspect of the present disclosure;

FIG. 11 schematically illustrates one aspect of a Power On function for the power/control unit, including a logic gate, for an electronic smoking article according to one aspect of the present disclosure;

FIG. 12 schematically illustrates aspects of the pressure sensor function and circuitry, for an electronic smoking article according to one aspect of the present disclosure.

DETAILED DESCRIPTION OF THE DISCLOSURE

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present disclosure provides articles that use electrical energy to heat a material (preferably without combusting the material to any significant degree) to form an inhalable substance, the articles being sufficiently compact to be considered "hand-held" devices. In certain embodiments, the articles can particularly be characterized as smoking articles. As used herein, the term is intended to mean an article that provides the taste and/or the sensation (e.g., hand-feel or mouth-feel) of smoking a cigarette, cigar, or pipe without substantial combustion of any component of the article. The term smoking article does not necessarily indicate that, in operation, the article produces smoke in the sense of the by-product of combustion or pyrolysis. Rather, smoking relates to the physical action of an individual in using the article—e.g., holding the article, drawing on one end of the article, and inhaling from the article. In further embodiments, the inventive articles can be characterized as being vapor-producing articles, aerosolization articles, or medicament delivery articles. Thus, the articles can be arranged so as to provide one or more substances in an inhalable state. In other embodiments, the inhalable substance can be substantially in the form of a vapor (i.e., a substance that is in the gas phase at a temperature lower than its critical point). In other embodiments, the inhalable substance can be in the form of an aerosol (i.e., a suspension of fine solid particles or liquid droplets in a gas). The physical form of the inhalable substance is not necessarily limited by the nature of the inventive articles but rather may depend upon the nature of the medium and the inhalable substance itself as to whether it exists in a vapor state or an aerosol state. In some embodiments, the terms may be interchangeable. Thus, for simplicity, the terms as used to describe the disclosure are understood to be interchangeable unless stated otherwise.

In one aspect, the present disclosure provides a smoking article. The smoking article generally can include a number of components provided within an elongated body, which can be a single, unitary shell or which can be formed of two or more separable pieces. For example, a smoking article according to one embodiment can comprise a shell (i.e., the elongated body) that can be substantially tubular in shape, such as resembling the shape of a conventional cigarette or cigar. Within the shell can reside all of the components of the smoking article. In other embodiments, a smoking article can comprise two shells that are joined and are separable. For example, a control body can comprise a shell containing one or more reusable components and having an end that removably attaches to a cartridge. The cartridge can comprise a shell containing one or more disposable components and having an end that removably attaches to the control body. More specific arrangements of components within the single shell or within the separable control body and cartridge are evident in light of the further disclosure provided herein.

Smoking articles useful according to the disclosure particularly can comprise some combination of a power source (i.e., an electrical power source), one or more control components (e.g., to control/actuate/regulate flow of power from the power source to one or more further components of the article), a heater component, and an aerosol precursor component. The smoking article further can include a defined air flow path through the article such that aerosol generated by the article can be withdrawn therefrom by a user drawing on the article. Alignment of the components within the article can vary. In specific embodiments, the aerosol precursor component can be located near an end of the article that is proximal to the mouth of a user so as to maximize aerosol delivery to the user. Other configurations, however, are not excluded. Generally, the heater component can be positioned sufficiently near that aerosol precursor component so that heat from the heater component can volatilize the aerosol precursor (as well as one or more flavorants, medicaments, or the like that may likewise be provided for delivery to a user) and form an aerosol for delivery to the user. When the heating member heats the aerosol precursor component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof.

A smoking article according to the disclosure generally can include a battery or other electrical power source to provide current flow sufficient to provide various functionalities to the article, such as resistive heating, powering of indicators, and the like. The power source for the inventive smoking article can take on various embodiments. Preferably, the power source is able to deliver sufficient power to rapidly heat the heating member to provide for aerosol formation and power the article through use for the desired duration of time. The power source preferably is sized to fit conveniently within the article. Examples of useful power sources include lithium ion batteries that preferably are rechargeable (e.g., a rechargeable lithium-manganese dioxide battery). In particular, lithium polymer batteries can be used as such batteries and can provide increased safety. Other types of batteries—e.g., N50-AAA CADNICA nickel-cadmium cells—may also be used. Even further examples of batteries that can be used according to the disclosure are described in US Pub. App. No. 2010/0028766, the disclosure of which is incorporated herein by reference in its entirety. Thin film batteries may be used in certain embodiments of the disclosure. Any of these batteries or combinations thereof can be used in the power source, but rechargeable batteries are preferred because of cost and disposal considerations associated with disposable batteries. In embodiments wherein disposable batteries are provided, the smoking article can include access for removal and replacement of the battery. Alternatively, in embodiments where rechargeable batteries are used, the smoking article can comprise charging contacts, for interaction with corresponding contacts in a conventional recharging unit deriving power from a standard 120-volt AC wall outlet, or other sources such as an automobile electrical system or a separate portable power supply, including USB connections. Means for recharging the battery can be provided in a portable charging case that can include, for example, a relatively larger battery unit that can provide multiple charges for the relatively smaller batteries present in the smoking article. The article further can include components for providing a non-contact inductive recharging system such that the article can be charged without being physically connected to an external power source. Thus, the article can include components to facilitate transfer of energy from an electromagnetic field to the rechargeable battery within the article.

In further embodiments, the power source also can comprise one or more capacitors. Capacitors are capable of discharging more quickly than batteries and can be charged between puffs, allowing the battery to discharge into the capacitor at a lower rate than if it were used to power the heating member directly. For example, a supercapacitor—i.e., an electric double-layer capacitor (EDLC)—may be used separate from or in combination with a battery. When used alone, the supercapacitor may be recharged before each use of the article. Thus, the disclosure also may include a charger component that can be attached to the smoking article between uses to replenish the supercapacitor.

The smoking article can further include a variety of power management software, hardware, and/or other electronic control components. For example, such software, hardware, and/or electronic controls can include carrying out charging of the battery, detecting the battery charge and discharge status, performing power save operations, preventing unintentional or over-discharge of the battery, or the like.

A "controller" or "control component" according to the present disclosure can encompass a variety of elements useful in the present smoking article. Moreover, a smoking article according to the disclosure can include one, two, or even more control components that can be combined into a unitary element or that can be present at separate locations within the smoking article, and individual control components can be utilized for carrying out different control aspects. For example, a smoking article can include a control component that is integral to or otherwise combined with a battery so as to control power discharge from the battery. The smoking article separately can include a control component that controls other aspects of the article. Alternatively, a single controller may be provided that carries out multiple control aspects or all control aspects of the article. Likewise, a sensor (e.g., a puff sensor) used in the article can include a control component that controls the actuation of power discharge from the power source in response to a stimulus. The smoking article separately can include a control component that controls other aspects of the article. Alternatively, a single controller may be provided in or otherwise associated with the sensor for carrying out multiple control aspects or all control aspects of the article. Thus, it can be seen that a variety of combinations of controllers may be combined in the present smoking article to provide the desired level of control of all aspects of the device.

The smoking article also can comprise one or more controller components useful for controlling flow of electrical energy from the power source to further components of the article, such as to a resistive heating element. Specifically, the article can comprise a control component that actuates current flow from the power source, such as to the resistive heating element. For example, in some embodiments, the article can include a pushbutton that can be linked to a control circuit for manual control of power flow, wherein a consumer can use the pushbutton to turn on the article and/or to actuate current flow into the resistive heating element. Multiple buttons can be provided for manual performance of powering the article on and off, and for activating heating for aerosol generation. One or more pushbuttons present can be substantially flush with an outer surface of the smoking article.

Instead of (or in addition to) the pushbutton, the inventive article can include one or more control components responsive to the consumer's drawing on the article (i.e., puff-actuated heating). For example, the article may include a switch that is sensitive either to pressure changes or air flow changes as the consumer draws on the article (i.e., a puff-actuated switch). Other suitable current actuation/deactuation mechanisms may include a temperature actuated on/off switch or a lip pressure actuated switch. An exemplary mechanism that can provide such puff-actuation capability includes a Model 163PC01D36 silicon sensor, manufactured by the MicroSwitch division of Honeywell, Inc., Freeport, Ill. With such sensor, the resistive heating element can be activated rapidly by a change in pressure when the consumer draws on the article. In addition, flow sensing devices, such as those using hot-wire anemometry principles, may be used to cause the energizing of the resistive heating element sufficiently rapidly after sensing a change in air flow. A further puff actuated switch that may be used is a pressure differential switch, such as Model No. MPL-502-V, range A, from Micro Pneumatic Logic, Inc., Ft. Lauderdale, Fla. Another suitable puff actuated mechanism is a sensitive pressure transducer (e.g., equipped with an amplifier or gain stage) which is in turn coupled with a comparator for detecting a predetermined threshold pressure. Yet another suitable puff actuated mechanism is a vane which is deflected by airflow, the motion of which vane is detected by a movement sensing means. Yet another suitable actuation mechanism is a piezoelectric switch. Also useful is a suitably connected Honeywell MicroSwitch Microbridge Airflow Sensor, Part No. AWM 2100V from MicroSwitch Division of Honeywell, Inc., Freeport, Ill. Further examples of demand-operated electrical switches that may be employed in a heating circuit according to the present disclosure are described in U.S. Pat. No. 4,735,217 to Gerth et al., which is incorporated herein by reference in its entirety. Other suitable differential switches, analog pressure sensors, flow rate sensors, or the like, will be apparent to the skilled artisan with the knowledge of the present disclosure. A pressure-sensing tube or other passage providing fluid connection between the puff actuated switch and an air flow passage within the smoking article can be included so that pressure changes during draw are readily identified by the switch. Further description of current regulating circuits and other control components, including microcontrollers, that can be useful in the present smoking article are provided in U.S. Pat. Nos. 4,922,901, 4,947,874, and 4,947,875, all to Brooks et al., U.S. Pat. No. 5,372,148 to McCafferty et al., U.S. Pat. No. 6,040,560 to Fleischhauer et al., and U.S. Pat. No. 7,040,314 to Nguyen et al., all of which are incorporated herein by reference in their entireties.

Capacitive sensing components in particular can be incorporated into the device in a variety of manners to allow for diverse types of "power-up" and/or "power-down" for one or more components of the device. Capacitive sensing can include the use of any sensor incorporating technology based on capacitive coupling including, but not limited to, sensors that detect and/or measure proximity, position or displacement, humidity, fluid level, pressure, or acceleration. Capacitive sensing can arise from electronic components providing for surface capacitance, projected capacitance, mutual capacitance, or self capacitance. Capacitive sensors generally can detect anything that is conductive or has a dielectric different than that of air. Capacitive sensors, for example, can replace mechanical buttons (i.e., the push-button referenced above) with capacitive alternatives. Thus, one specific application of capacitive sensing according to the disclosure is a touch capacitive sensor. For example, a touch pad can be present on the smoking article that allows the user to input a variety of commands. Most basically, the touch pad can provide for powering the heating element much in the same manner as a push button, as already described above. In other embodiments, capacitive sensing can be applied near the mouth end of the smoking article such that the pressure of the lips on the smoking article to draw on the article can signal the device to provide power to the heating element. In addition to touch capacitance sensors, motion capacitance sensors, liquid capacitance sensors, and accelerometers can be utilized according to the disclosure to illicit a variety of responses from the smoking article. Further, photoelectric sensors also can be incorporated into the inventive smoking article.

Sensors utilized in the present articles can expressly signal for power flow to the heating element so as to heat the substrate including the aerosol precursor material and form a vapor or aerosol for inhalation by a user. Sensors also can provide further functions. For example, a "wake-up" sensor can be included. Other sensing methods providing similar function likewise can be utilized according to the disclosure.

When the consumer draws on the mouth end of the smoking article, the current actuation means can permit unrestricted or uninterrupted flow of current through the resistive heating member to generate heat rapidly. Because of the rapid heating, it can be useful to include current regulating components to (i) regulate current flow through the heating member to control heating of the resistive element and the temperature experienced thereby, and (ii) prevent overheating and degradation of the substrate or other component carrying the aerosol precursor material and/or other flavors or inhalable materials.

The current regulating circuit particularly may be time based. Specifically, in one aspect, such a circuit includes a means for permitting uninterrupted current flow through the heating element for an initial time period during draw, and a timer means for subsequently regulating current flow until draw is completed. For example, the subsequent regulation can include the rapid on-off switching of current flow (e.g., on the order of about every 1 to 50 milliseconds) to maintain the heating element within the desired temperature range. Further, regulation may comprise simply allowing uninterrupted current flow until the desired temperature is achieved then turning off the current flow completely. The heating member may be reactivated by the consumer initiating another puff on the article (or manually actuating the pushbutton, depending upon the specific switch embodiment employed for activating the heater). Alternatively, the subsequent regulation can involve the modulation of current flow through the heating element to maintain the heating element within a desired temperature range. In some embodiments, so as to release the desired dosing of the inhalable substance, the heating member may be energized for a duration of about 0.2 second to about 5.0 seconds, about 0.3 second to about 4.5 seconds, about 0.5 second to about 4.0 seconds, about 0.5 second to about 3.5 seconds, or about 0.6 second to about 3.0 seconds. One exemplary time-based current regulating circuit can include a transistor, a timer, a comparator, and a capacitor. Suitable transistors, timers, comparators, and capacitors are commercially available and will be apparent to the skilled artisan. Exemplary timers are those available from NEC Electronics as C-1555C and from General Electric Intersil, Inc. as ICM7555, as well as various other sizes and configurations of so-called "555 Timers". An exemplary comparator is available from National Semiconductor as LM311. Further description of such time-based current regulating circuits and other control components that can be useful in the present smoking article are provided in U.S. Pat. Nos. 4,922,901, 4,947,874, and 4,947,875, all to Brooks et al., all of which are incorporated herein by reference in their entireties.

The control components particularly can be configured to closely control the amount of heat provided to the resistive heating element. In some embodiments, the current regulating component can function to stop current flow to the resistive heating element once a defined temperature has been achieved. Such defined temperature can be in a range that is substantially high enough to volatilize the aerosol precursor material and any further inhalable substances and provide an amount of aerosol equivalent to a typical puff on a conventional cigarette, as otherwise discussed herein. While the heat needed to volatilize the aerosol precursor material in a sufficient volume to provide a desired volume for a single puff can vary, it can be particularly useful for the heating member to heat to a temperature of about 120° C. or greater, about 130° C. or greater, about 140° C. or greater, or about 160° C. In some embodiments, in order to volatilize an appropriate amount of the aerosol precursor material, the heating temperature may be about 180° C. or greater, about 200° C. or greater, about 300° C. or greater, or about 350° C. or greater. In further embodiments, the defined temperature for aerosol formation can be about 120° C. to about 350° C., about 140° C. to about 300° C., or about 150° C. to about 250° C. The temperature and time of heating can be controlled by one or more components contained in the control housing. The current regulating component likewise can cycle the current to the resistive heating element off and on once a defined temperature has been achieved so as to maintain the defined temperature for a defined period of time.

Still further, the current regulating component can cycle the current to the resistive heating element off and on to maintain a first temperature that is below an aerosol forming temperature and then allow an increased current flow in response to a current actuation control component so as to achieve a second temperature that is greater than the first temperature and that is an aerosol forming temperature. Such controlling can improve the response time of the article for aerosol formation such that aerosol formation begins almost instantaneously upon initiation of a puff by a consumer. In some embodiments, the first temperature (which can be characterized as a standby temperature) can be only slightly less than the aerosol forming temperature defined above. Specifically, the standby temperature can be about 50° C. to about 150° C., about 70° C. to about 140° C., about 80° C. to about 120° C., or about 90° C. to about 110° C.

In addition to the above control elements, the smoking article also may comprise one or more indicators. Such indicators may be lights (e.g., light emitting diodes) that can provide indication of multiple aspects of use of the inventive article. Further, LED indicators may be positioned at the distal end of the smoking article to simulate color changes seen when a conventional cigarette is lit and drawn on by a user. Other indices of operation also are encompassed. For example, visual indicators also may include changes in light color or intensity to show progression of the smoking experience. Tactile indicators and sound indicators similarly are encompassed by the disclosure. Moreover, combinations of such indicators also may be used in a single article.

A smoking article according to the disclosure further can comprise a heating member that heats an aerosol precursor component to produce an aerosol for inhalation by a user. In various embodiments, the heating member can be formed of a material that provides resistive heating when an electrical current is applied thereto. Preferably, the resistive heating element exhibits an electrical resistance making the resistive heating element useful for providing a sufficient quantity of heat when electrical current flows therethrough. Interaction of the heating member with the aerosol precursor component/composition may be through, for example, heat conduction, heat radiation, and/or heat convection.

Electrically conductive materials useful as resistive heating elements can be those having low mass, low density, and moderate resistivity and that are thermally stable at the temperatures experienced during use. Useful heating elements heat and cool rapidly, and thus provide for the efficient use of energy. Rapid heating of the element can be beneficial to provide almost immediate volatilization of an aerosol precursor material in proximity thereto. Rapid cooling (i.e., to a temperature below the volatilization temperature of the aerosol precursor component/composition/material) prevents substantial volatilization (and hence waste) of the aerosol precursor material during periods when aerosol formation is not desired. Such heating elements also permit relatively precise control of the temperature range experienced by the aerosol precursor material, especially when time based current control is employed. Useful electrically conductive materials preferably are chemically non-reactive with the materials being heated (e.g., aerosol precursor materials and other inhalable substance materials) so as not to adversely affect the flavor or content of the aerosol or vapor that is produced. Exemplary, non-limiting, materials that can be used as the electrically conductive material include carbon, graphite, carbon/graphite composites, metals, metallic and non-metallic carbides, nitrides, silicides, inter-metallic compounds, cermets, metal alloys, and metal foils. In particular, refractory materials may be useful. Various, different materials can be mixed to achieve the desired properties of resistivity, mass, and thermal conductivity. In specific embodiments, metals that can be utilized include, for example, nickel, chromium, alloys of nickel and chromium (e.g., nichrome), and steel. Materials that can be useful for providing resistive heating are described in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; U.S. Pat. No. 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., the disclosures of which are incorporated herein by reference in their entireties.

The resistive heating element can be provided in a variety forms, such as in the form of a foil, a foam, discs, spirals, fibers, wires, films, yarns, strips, ribbons, or cylinders, as well as irregular shapes of varying dimensions. In some embodiments, a resistive heating element according to the present disclosure can be a conductive substrate, such as described in co-pending U.S. patent application Ser. No. 13/432,406, filed Mar. 28, 2012, the disclosure of which is incorporated herein by reference in its entirety. The resistive heating element also may be present as part of a microheater component, such as described in co-pending U.S. patent application Ser. No. 13/602,871, filed Sep. 4, 2012, the disclosure of which is incorporated herein by reference in its entirety.

Beneficially, the resistive heating element can be provided in a form that enables the heating element to be positioned in intimate contact with or in close proximity to the aerosol precursor material (i.e. to provide heat to the aerosol precursor material through, for example, conduction, radiation, or convection). In other embodiments, the resistive heating element can be provided in a form such that the aerosol precursor material can be delivered to the resistive heating element for aerosolization. Such delivery can take on a variety of embodiments, such as wicking of the aerosol precursor to the resistive heating element and flowing the aerosol precursor to the resistive heating element, such as through a capillary, which may include valve flow regulation. As such, the aerosol precursor material may be provided in liquid form in one or more reservoirs positioned sufficiently away from the resistive heating element to prevent premature aerosolization, but positioned sufficiently close to the resistive heating element to facilitate transport of the aerosol precursor material, in the desired amount, to the resistive heating element for aerosolization.

In certain embodiments, a smoking article according to the present disclosure can include tobacco, a tobacco component, or a tobacco-derived material (i.e., a material that is found naturally in tobacco that may be isolated directly from the tobacco or synthetically prepared). The tobacco that is employed can include, or can be derived from, tobaccos such as flue-cured tobacco, burley tobacco, Oriental tobacco, Maryland tobacco, dark tobacco, dark-fired tobacco and Rustica tobacco, as well as other rare or specialty tobaccos, or blends thereof. Various representative tobacco types, processed types of tobaccos, and types of tobacco blends are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No.

5,220,930 to Gentry; U.S. Pat. No. 5,360,023 to Blakley et al.; U.S. Pat. No. 6,701,936 to Shafer et al.; U.S. Pat. No. 6,730,832 to Dominguez et al., U.S. Pat. No. 7,011,096 to Li et al.; U.S. Pat. No. 7,017,585 to Li et al.; U.S. Pat. No. 7,025,066 to Lawson et al.; US Pat. App. Pub. No. 2004/0255965 to Perfetti et al.; PCT Pub. WO 02/37990 to Bereman; and Bombick et al., *Fund. Appl. Toxicol.,* 39, p. 11-17 (1997); the disclosures of which are incorporated herein by reference in their entireties.

The tobacco that is incorporated within the smoking article can be employed in various forms; and combinations of various forms of tobacco can be employed, or different forms of tobacco can be employed at different locations within the smoking article. For example, the tobacco can be employed in the form of a tobacco extract. See, for example, U.S. Pat. No. 7,647,932 to Cantrell et al.; U.S. Pat. No. 8,079,371 to Robinson et al.; and US Pat. Pub. No. 2007/0215167 to Crooks et al., the disclosures of which are incorporated herein by reference in their entireties.

The smoking article can incorporate tobacco additives of the type that are traditionally used for the manufacture of tobacco products. Those additives can include the types of materials used to enhance the flavor and aroma of tobaccos used for the production of cigars, cigarettes, pipes, and the like. For example, those additives can include various cigarette casing and/or top dressing components. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin; the disclosures of which are incorporated herein by reference in their entireties. Preferred casing materials include water, sugars and syrups (e.g., sucrose, glucose and high fructose corn syrup), humectants (e.g. glycerin or propylene glycol), and flavoring agents (e.g., cocoa and licorice). Those added components also include top dressing materials (e.g., flavoring materials, such as menthol). See, for example, U.S. Pat. No. 4,449,541 to Mays et al., the disclosure of which is incorporated herein by reference in its entirety. Further materials that can be added include those disclosed in U.S. Pat. No. 4,830,028 to Lawson et al. and US Pat. Pub. No. 2008/0245377 to Marshall et al., the disclosures of which are incorporated herein by reference in their entireties.

Various manners and methods for incorporating tobacco into smoking articles, and particularly smoking articles that are designed so as to not purposefully burn virtually all of the tobacco within those smoking articles, are set forth in U.S. Pat. No. 4,947,874 to Brooks et al.; U.S. Pat. No. 7,647,932 to Cantrell et al.; U.S. Pat. No. 8,079,371 to Robinson et al.; US Pat. App. Pub. No. 2005/0016549 to Banerjee et al.; and US Pat. App. Pub. No. 2007/0215167 to Crooks et al.; the disclosures of which are incorporated herein by reference in their entireties.

Further tobacco materials, such as a tobacco aroma oil, a tobacco essence, a spray dried tobacco extract, a freeze dried tobacco extract, tobacco dust, or the like may be included in the vapor precursor or aerosol precursor composition. As used herein, the term "tobacco extract" means components separated from, removed from, or derived from, tobacco using tobacco extraction processing conditions and techniques. Purified extracts of tobacco or other botanicals specifically can be used. Typically, tobacco extracts are obtained using solvents, such as solvents having an aqueous nature (e.g., water) or organic solvents (e.g., alcohols, such as ethanol or alkanes, such as hexane). As such, extracted tobacco components are removed from tobacco and separated from the unextracted tobacco components; and for extracted tobacco components that are present within a solvent, (i) the solvent can be removed from the extracted tobacco components, or (ii) the mixture of extracted tobacco components and solvent can be used as such. Exemplary types of tobacco extracts, tobacco essences, solvents, tobacco extraction processing conditions and techniques, and tobacco extract collection and isolation procedures, are set forth in Australia Pat. No. 276,250 to Schachner; U.S. Pat. No. 2,805,669 to Meriro; U.S. Pat. No. 3,316,919 to Green et al.; U.S. Pat. No. 3,398,754 to Tughan; U.S. Pat. No. 3,424,171 to Rooker; U.S. Pat. No. 3,476,118 to Luttich; U.S. Pat. No. 4,150,677 to Osborne; U.S. Pat. No. 4,131,117 to Kite; U.S. Pat. No. 4,506,682 to Muller; U.S. Pat. No. 4,986,286 to Roberts et al.; U.S. Pat. No. 5,005,593 to Fagg; U.S. Pat. No. 5,065,775 to Fagg; U.S. Pat. No. 5,060,669 to White et al.; U.S. Pat. No. 5,074,319 to White et al.; U.S. Pat. No. 5,099,862 to White et al.; U.S. Pat. No. 5,121,757 to White et al.; U.S. Pat. No. 5,131,415 to Munoz et al.; U.S. Pat. No. 5,230,354 to Smith et al.; U.S. Pat. No. 5,235,992 to Sensabaugh; U.S. Pat. No. 5,243,999 to Smith; U.S. Pat. No. 5,301,694 to Raymond; U.S. Pat. No. 5,318,050 to Gonzalez-Parra et al.; U.S. Pat. No. 5,435,325 to Clapp et al.; and U.S. Pat. No. 5,445,169 to Brinkley et al.; the disclosures of which are incorporated herein by reference in their entireties.

The aerosol precursor or vapor precursor material can comprise one or more different components. For example, the aerosol precursor can include a polyhydric alcohol (e.g., glycerin, propylene glycol, or a mixture thereof). Representative types of further aerosol precursor materials are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. Further exemplary formulations for aerosol precursor materials that may be used according to the present disclosure are described in U.S. Pat. Pub. No. 2013/0008457 to Zheng et al., the disclosure of which is incorporated herein by reference in its entirety. In some embodiments, an aerosol precursor composition can produce a visible aerosol upon the application of sufficient heat thereto (and cooling with air, if necessary), and the aerosol precursor composition can produce an aerosol that can be considered to be "smoke-like." In other embodiments, the aerosol precursor composition can produce an aerosol that can be substantially non-visible but can be recognized as present by other characteristics, such as flavor or texture. Thus, the nature of the produced aerosol can vary depending upon the specific components of the aerosol precursor composition. The aerosol precursor composition can be chemically simple relative to the chemical nature of the smoke produced by burning tobacco.

Aerosol precursor materials can be combined with other liquid materials. For example, aerosol precursor material formulations can incorporate mixtures of glycerin and water, or mixtures of propylene glycol and water, or mixtures of propylene glycol and glycerin, or mixtures of propylene glycol, glycerin, and water. Exemplary aerosol precursor materials also include those types of materials incorporated within devices available through Atlanta Imports Inc., Acworth, Ga., USA., as an electronic cigar having the brand name E-CIG, which can be employed using associated Smoking Cartridges Type C1a, C2a, C3a, C4a, C1b, C2b, C3b and C4b; and as Ruyan Atomizing Electronic Pipe and Ruyan Atomizing Electronic Cigarette from Ruyan SBT Technology and Development Co., Ltd., Beijing, China.

The smoking article further can comprise one or more flavors, medicaments, or other inhalable materials. For example, liquid nicotine can be used. Such further materials may be combined with the aerosol precursor or vapor precursor material. Thus, the aerosol precursor or vapor precursor material may be described as comprising an inhalable substance in addition to the aerosol. Such inhalable substance can include flavors, medicaments, and other materials as discussed herein. Particularly, an inhalable substance delivered using a smoking article according to the present disclosure can comprise a tobacco component or a tobacco-derived material. For example, the aerosol precursor material can be in a slurry with tobacco or a tobacco component, or in solution with a tobacco-derived material. Alternately, the flavor, medicament, or other inhalable material can be provided separate from the aerosol precursor—e.g., in a reservoir. As such, defined aliquots of the flavor, medicament, or other inhalable material may be separately or simultaneously delivered to the resistive heating element to release the flavor, medicament, or other inhalable material into an air stream to be inhaled by a user along with the aerosol precursor or vapor precursor material. Alternatively, the flavor, medicament, or other inhalable material may be provided in a separate portion of the smoking article or a component thereof. In specific embodiments, the flavor, medicament, or other inhalable material can be deposited on a substrate (e.g., a paper or other porous material) that is located in proximity to the resistive heating element. The proximity preferably is sufficient such that heating of the resistive heating element provides heat to the substrate sufficient to volatilize and release the flavor, medicament, or other inhalable material from the substrate.

A wide variety of types of flavoring agents, or materials that alter the sensory or organoleptic character or nature of the mainstream aerosol of the smoking article, can be employed. Such flavoring agents can be provided from sources other than tobacco, can be natural or artificial in nature, and can be employed as concentrates or flavor packages. Of particular interest are flavoring agents that are applied to, or incorporated within, those regions of the smoking article where aerosol is generated. Again, such agents can be supplied directly to the resistive heating element or may be provided on a substrate as already noted above. Exemplary flavoring agents include vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, also can be employed. Flavoring agents also can include acidic or basic characteristics (e.g., organic acids, such as levulinic acid, succinic acid, and pyruvic acid). The flavoring agents can be combined with the aerosol-generating material if desired. Exemplary plant-derived compositions that may be used are disclosed in U.S. application Ser. No. 12/971,746 to Dube et al. and U.S. application Ser. No. 13/015,744 to Dube et al., the disclosures of which are incorporated herein by reference in their entireties. The selection of such further components can vary based upon factors such as the sensory characteristics that are desired for the present article, and the present disclosure is intended to encompass any such further components that may be readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties. Any of the materials, such as flavorings, casings, and the like that can be useful in combination with a tobacco material to affect sensory properties thereof, including organoleptic properties, such as already described herein, may be combined with the aerosol precursor material. Organic acids particularly may be incorporated into the aerosol precursor composition to affect the flavor, sensation, or organoleptic properties of medicaments, such as nicotine, that may be combined with the aerosol precursor composition. For example, organic acids, such as levulinic acid, lactic acid, and pyruvic acid, may be included in the aerosol precursor composition with nicotine in amounts up to being equimolar (based on total organic acid content) with the nicotine. Any combination of organic acids can be used. For example, the aerosol precursor composition can include about 0.1 to about 0.5 moles of levulinic acid per one mole of nicotine, about 0.1 to about 0.5 moles of pyruvic acid per one mole of nicotine, about 0.1 to about 0.5 moles of lactic acid per one mole of nicotine, or combinations thereof, up to a concentration wherein the total amount of organic acid present is equimolar to the total amount of nicotine present in the aerosol precursor composition.

The aerosol precursor material may take on a variety of conformations based upon the various amounts of materials utilized therein. For example, a useful aerosol precursor material may comprise up to about 98% by weight up to about 95% by weight, or up to about 90% by weight of a polyol. This total amount can be split in any combination between two or more different polyols. For example, one polyol can comprise about 50% to about 90%, about 60% to about 90%, or about 75% to about 90% by weight of the aerosol precursor material, and a second polyol can comprise about 2% to about 45%, about 2% to about 25%, or about 2% to about 10% by weight of the aerosol precursor material. A useful aerosol precursor material also can comprise up to about 25% by weight, about 20% by weight or about 15% by weight water—particularly about 2% to about 25%, about 5% to about 20%, or about 7% to about 15% by weight water. Flavors and the like (which can include medicaments, such as nicotine) can comprise up to about 10%, up to about 8%, or up to about 5% by weight of the aerosol precursor material.

As a non-limiting example, an aerosol precursor material according to the disclosure can comprise glycerol, propylene glycol, water, nicotine, and one or more flavors. Specifically, the glycerol can be present in an amount of about 70% to about 90% by weight, about 70% to about 85% by weight, or about 75% to about 85% by weight, the propylene glycol can be present in an amount of about 1% to about 10% by weight, about 1% to about 8% by weight, or about 2% to about 6% by weight, the water can be present in an amount of about 10% to about 20% by weight, about 10% to about 18% by weight, or about 12% to about 16% by weight, the nicotine can be present in an amount of about 0.1% to about 5% by weight, about 0.5% to about 4% by weight, or about 1% to about 3% by weight, and the flavors can be present in an amount of up to about 5% by weight, up to about 3% by weight, or up to about 1% by weight, all amounts being based on the total weight of the aerosol precursor material. One specific, non-limiting example of an aerosol precursor material comprises about 75% to about 80% by weight glycerol, about 13% to about 15% by weight water, about 4% to about 6% by weight propylene glycol, about 2% to about 3% by weight nicotine, and about 0.1% to about 0.5% by weight flavors. The nicotine, for example, can be a high nicotine content tobacco extract.

In embodiments of the aerosol precursor material that contain a tobacco extract, including pharmaceutical grade nicotine derived from tobacco, it is advantageous for the tobacco extract to be characterized as substantially free of compounds collectively known as Hoffmann analytes, including, for example, tobacco-specific nitrosamines (TSNAs), including N'-nitrosonornicotine (NNN), (4-methylnitrosamino)-1-(3-pyridyl)-1-butanone (NNK), N'-nitrosoanatabine (NAT), and N'-nitrosoanabasine (NAB); polyaromatic hydrocarbons (PAHs), including benz[a]anthracene, benzo[a]pyrene, benzo[b]fluoranthene, benzo[k]fluoranthene, chrysene, dibenz[a,h]anthracene, and indeno[1,2,3-cd]pyrene, and the like. In certain embodiments, the aerosol precursor material can be characterized as completely free of any Hoffmann analytes, including TSNAs and PAHs. Embodiments of the aerosol precursor material may have TSNA levels (or other Hoffmann analyte levels) in the range of less than about 5 ppm, less than about 3 ppm, less than about 1 ppm, or less than about 0.1 ppm, or even below any detectable limit. Certain extraction processes or treatment processes can be used to achieve reductions in Hoffmann analyte concentration. For example, a tobacco extract can be brought into contact with an imprinted polymer or non-imprinted polymer such as described, for example, in US Pat. Pub. Nos. 2007/0186940 to Bhattacharyya et al; 2011/0041859 to Rees et al.; 2011/0159160 to Jonsson et al; and 2012/0291793 to Byrd et al., all of which are incorporated herein by reference. Further, the tobacco extract could be treated with ion exchange materials having amine functionality, which can remove certain aldehydes and other compounds. See, for example, U.S. Pat. No. 4,033,361 to Horsewell et al. and U.S. Pat. No. 6,779,529 to Figlar et al., which are incorporated by reference herein.

The amount of aerosol precursor material that is used within the smoking article is such that the article exhibits acceptable sensory and organoleptic properties, and desirable performance characteristics. For example, it is highly preferred that sufficient aerosol precursor material, such as glycerin and/or propylene glycol, be employed in order to provide for the generation of a visible mainstream aerosol that in many regards resembles the appearance of tobacco smoke. Typically, the amount of aerosol-generating material incorporated into the smoking article is in the range of about 1.5 g or less, about 1 g or less, or about 0.5 g or less. The amount of aerosol precursor material can be dependent upon factors such as the number of puffs desired per cartridge used with the smoking article. It is desirable for the aerosol-generating composition not to introduce significant degrees of unacceptable off-taste, filmy mouth-feel, or an overall sensory experience that is significantly different from that of a traditional type of cigarette that generates mainstream smoke by burning tobacco cut filler. The selection of the particular aerosol-generating material and reservoir material, the amounts of those components used, and the types of tobacco material used, can be altered in order to control the overall chemical composition of the mainstream aerosol produced by the smoking article.

The amount of aerosol released by the inventive article can vary. Preferably, the article is configured with a sufficient amount of the aerosol precursor material, with a sufficient amount of any further inhalable substance, and to function at a sufficient temperature for a sufficient time to release a desired content of aerosolized materials over a course of use. The content may be provided in a single inhalation from the article or may be divided so as to be provided through a number of puffs from the article over a relatively short length of time (e.g., less than 30 minutes, less than 20 minutes, less than 15 minutes, less than 10 minutes, or less than 5 minutes). For example, the article may provide nicotine in an amount of about 0.01 mg to about 0.5 mg, about 0.05 mg to about 0.3 mg, or about 0.1 mg to about 0.2 mg, per puff on the article. For purposes of calculations, an average puff time of about 2 seconds can deliver a puff volume of about 5 ml to about 100 ml, about 15 ml to about 70 ml, about 20 ml to about 60 ml, or about 25 ml to about 50 ml. A smoking article according to the disclosure can be configured to provide any number of puffs calculable by the total amount of aerosol or other inhalable substance to be delivered divided by the amount to be delivered per puff. The one or more reservoirs can be loaded with the appropriate amount of aerosol precursor or other inhalable substance to achieve the desired number of puffs and/or the desired total amount of material to be delivered.

In further embodiments, heating can be characterized in relation to the amount of aerosol to be generated. Specifically, the article can be configured to provide an amount of heat necessary to generate a defined volume of aerosol (e.g., about 5 ml to about 100 ml, or any other volume deemed useful in a smoking article, such as otherwise described herein). In certain, the amount of heat generated can be measured in relation to a two second puff providing about 35 ml of aerosol at a heater temperature of about 290° C. In some embodiments, the article preferably can provide about 1 to about 50 Joules of heat per second (J/s), about 2 J/s to about 40 J/s, about 3 J/s to about 35 J/s, or about 5 J/s to about 30 J/s.

The resistive heating element preferably is in electrical connection with the power source of the smoking article such that electrical energy can be provided to the resistive heating element to produce heat and subsequently aerosolize the aerosol precursor material and any other inhalable substance provided by the smoking article. Such electrical connection can be permanent (e.g., hard wired) or can be removable (e.g., wherein the resistive heating element is provided in a cartridge that can be attached to and detached from a control body that includes the power source).

Although a variety of materials for use in a smoking article according to the present disclosure have been described above—such as heaters, batteries, capacitors, switching components, aerosol precursors, and the like, the disclosure should not be construed as being limited to only the exemplified embodiments. Rather, one of skill in the art can recognize based on the present disclosure similar components in the field that may be interchanged with any specific component of the present disclosure. For example, U.S. Pat. No. 5,261,424 to Sprinkel, Jr. discloses piezoelectric sensors that can be associated with the mouth-end of a device to detect user lip activity associated with taking a draw and then trigger heating; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; US 2009/0320863 by Fernando et al. discloses computer interfacing means for smoking devices to facilitate charging and allow computer control of the device; US 2010/0163063 by Fernando et al. discloses identification systems for smoking devices; and WO 2010/003480 by Flick discloses a fluid flow sensing system indicative of a puff in an aerosol generating system; all of the foregoing disclosures being incorporated herein by reference in their entireties. Further examples of components related to electronic aerosol delivery articles and disclosing materials or components that may be used in the present article include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; US Pat. Pub. Nos. 2009/0095311, 2006/0196518, 2009/0126745, and 2009/0188490 to Hon; US Pat. Pub. No. 2009/0272379 to Thorens et al.; US Pat. Pub. Nos. 2009/0260641 and 2009/0260642 to Monsees et al.; US Pat. Pub. Nos. 2008/0149118 and 2010/0024834 to Oglesby et al.; US Pat. Pub. No. 2010/0307518 to Wang; and WO 2010/091593 to Hon. A variety of the materials disclosed by the foregoing documents may be incorporated into the present devices in various embodiments, and all of the foregoing disclosures are incorporated herein by reference in their entireties.

Although an article according to the disclosure may take on a variety of embodiments, as discussed in detail below, the use of the article by a consumer will be similar in scope. In particular, the article can be provided as a single unit or as a plurality of components that are combined by the consumer for use and then are dismantled by the consumer thereafter. Generally, a smoking article according to the disclosure can comprise a first unit that is engagable and disengagable with a second unit, the first unit comprising the resistive heating element, and the second unit comprising the electrical power source. In some embodiments, the second unit further can comprise one or more control components that actuate or regulate current flow from the electrical power source. The first unit can comprise a distal end that engages the second unit and an opposing, proximate end that includes a mouthpiece (or simply the mouth end) with an opening at a proximate end thereof. The first unit can comprise an air flow path opening into the mouthpiece of the first unit, and the air flow path can provide for passage of aerosol formed from the resistive heating element into the mouthpiece. In preferred embodiments, the first unit can be disposable. Likewise, the second unit can be reusable.

Figure 1:
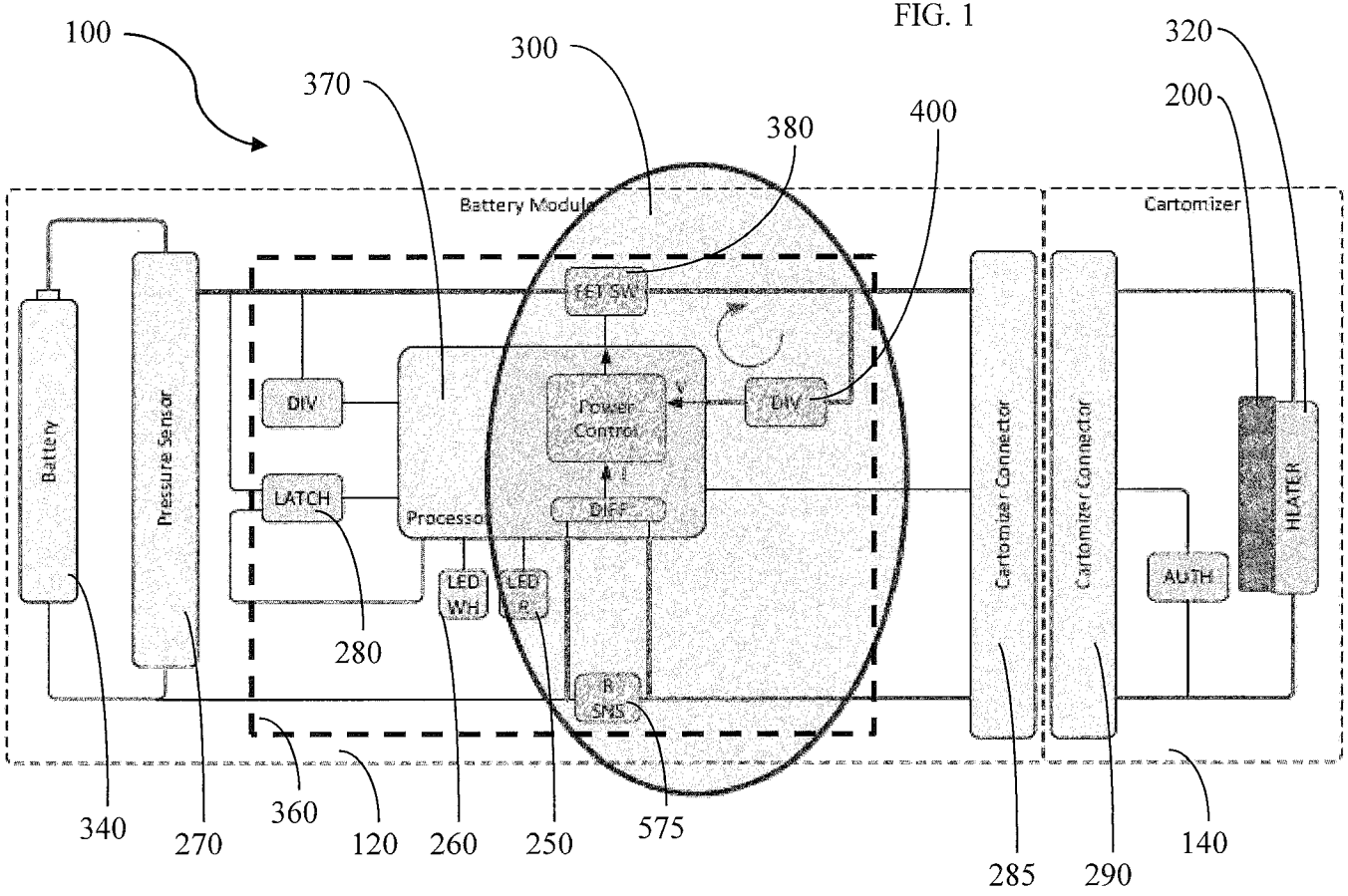
FIG. 1 is a schematic of an electronic smoking article incorporating a heating apparatus for an aerosol precursor component or arrangement, according to one aspect of the disclosure.
Figure 2:
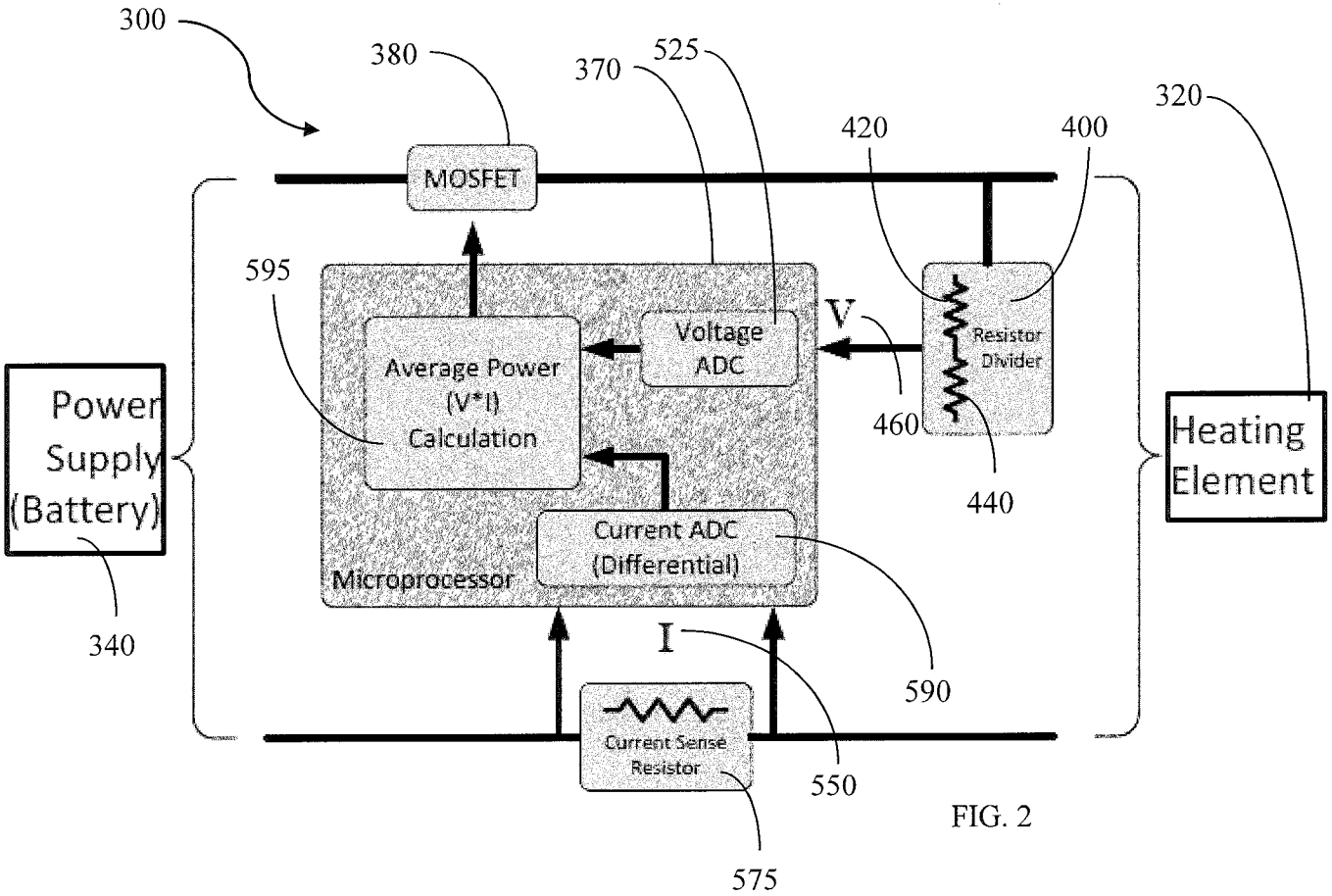
FIG. 2 is a schematic of a heating apparatus for an aerosol precursor component or arrangement of an electronic smoking article, according to one aspect of the disclosure.

One aspect of the present disclosure provides an apparatus and method for controlling/actuating/regulating flow of power from the power source to the heater component. More particularly, as shown in FIGS. 1 and 2, such an aspect implements a heating apparatus 300 for an aerosol precursor component or aerosol precursor arrangement 200 of an electronic smoking article 100, wherein the heating apparatus 300 may comprise a heating device or heating component 320 arranged to heat the aerosol precursor component 200, and wherein a power source 340 may also be included and arranged in communication with the heating component 320. Various examples, configurations, and arrangements of such a heating device or heating component 320, aerosol precursor component 200, and power source 340, in relation to an electronic smoking article 100, have been heretofore disclosed and details of each and combinations thereof discussed herein are applicable to the inventive aspects of the present disclosure.

Further, in the inventive aspects disclosed herein, the heating apparatus 300 may also include a controller 360 or appropriate control device in communication with the heating component 320 and the power source 340. In some aspects, the controller 360 may include a processor 370 configured to at least direct the power source 340 to provide an average power to the heating component 320, and to commensurately initiate a heating time period, wherein the average power corresponds to a selected power set point associated with the power source 340. The controller 360 may also be configured to determine an actual power directed to the heating component 320, as a product of a voltage at the heating component 320 and a current through the heating component 320. The controller 360 may further be configured to compare the actual power to the average power, and adjust the average power directed to the heating component 320 so as to adjust or otherwise direct the actual power directed toward the heating component 320 toward the selected power set point. In addition, the controller 360 may be configured to periodically determine the actual power, to subsequently compare the actual power to the average power, and then adjust the average power directed to the heating component 320 to direct the actual power toward the selected power set point, until expiration of the heating time period. That is, the controller 360, during the heating time period, may be configured to continually or periodically monitor the actual power directed to the heating component 320 from the power source 340, to compare that actual power to the average power (i.e., the selected power set point associated with the power source 340), and then adjust, as necessary, the average power directed from the power source 340 to the heating component 320 such that the average power is directed toward the actual power received by the heating component 320 (i.e., the average power may be increased or decreased, as necessary, such that the actual power directed to the heating component 320 corresponds to or otherwise approximates the specified average power or selected power set point associated with the controller 360).

Figure 3:
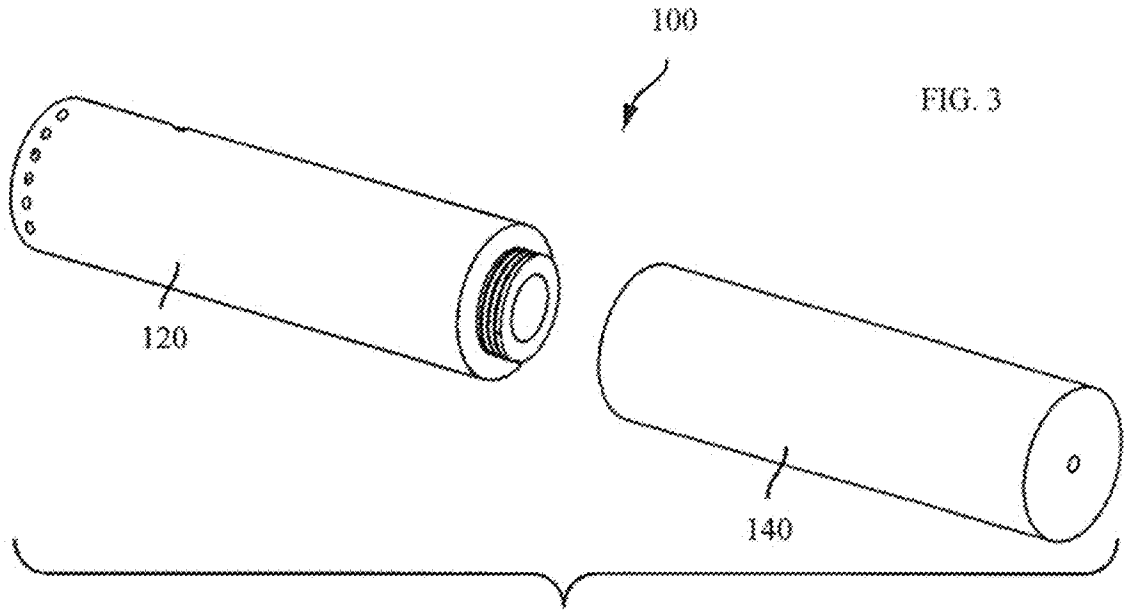
FIG. 3 is a perspective view of an example embodiment of an electronic smoking article according to the disclosure, wherein the article comprises a control body portion and a cartridge portion that are attachable and detachable with respect to each other.

As previously disclosed, and as shown in FIG. 3, a control body portion 120 of the electronic smoking article 100 can comprise a shell containing one or more reusable components and having an end that removably attaches to a cartridge portion 140. The cartridge portion 140 can comprise a shell containing one or more disposable components and having an end that removably attaches to the control body portion 120. Particular arrangements of components within the separable control body portion 120 and cartridge portion 140 may be implemented according to disclosure otherwise provided herein. For example, the power source 340 may be arranged within the control body portion 120, while the heating component 320 and aerosol precursor component 200 may be arranged within the cartridge portion 140, with the power source 340 forming a communication with the heating component 320 upon connecting the respective ends of the control body portion 120 and the cartridge portion 140. While the controller 360 may disposed and arranged in either the control body portion 120 or the cartridge portion 140, in particular aspects, the controller 360 is arranged in the control body portion 120.

The controller 360, or at least the processor 370 associated therewith, is arranged to be in communication with the power source 340 and the heating component 320 (upon engagement between the control body portion 120 and the cartridge portion 140). According to the inventive aspects disclosed herein, the processor 370 (or generally the controller 360, as appropriate) may be configured to be responsive to a control component that actuates current flow from the power source 340 to the heating component 320, wherein such a control component may include, for example, a user-actuated pushbutton, a puff sensor, and/or any other such control component as disclosed herein for actuating the heating component to heat the aerosol precursor component. In response to the control component, the processor 370 may be configured to at least direct the power source 340 to provide an average power to the heating component 320. For example, the processor 370 may be configured to include information related to the necessary electrical current directed to the heating component 320 to cause the heating component 320 to attain a temperature (i.e., through resistive heating or otherwise through any other type of electrically-driven heating disclosed herein) that is substantially high enough to volatilize the aerosol precursor component 200. Thus, the processor 370 may determine and control the average power (i.e., the voltage of the power source 340 multiplied by the necessary electrical current directed to the heating component 320) that is directed to the heating component 320 upon actuation by the control component. In some instances, the controller 360 may be configured to actuate a switch device 380, in electrical communication between the power source 340 and the heating component 320, to direct the electrical current flow from the power source 340 to the heating component 320, in response to the control component. That is, the control component may be configured to actuate the controller 360 which, in turn or in response, actuates the switch device 380 to initiate the electrical current flow to the heating component 320. The switch device 380 may be, for example, of an on/off type or a variable type switch device. In one aspect, the switch device 380 may comprise, for example, a MOSFET used as an on/off switch device for directing power to the heating component 320. In such a configuration, it may be important for the "on" resistance of such a switch device to be relatively low or as low as possible, so that power is not lost upon being directed through the MOSFET to the heating component 320 (i.e., the MOSFET may have a preferred series resistance, RDS(on), of less than 50 mOhms).

In some instances, the average power may correspond to a selected power set point associated with the power source 340 (i.e., a power level or current output from the power source 340 regulated by the processor 370, or other regulating component associated therewith and disposed in electrical communication between the power source 340 and the heating component 320). The necessary electrical current directed to the heating component 320 may be predetermined (i.e., each cartridge portion 140 that may be engaged with the control body portion 120 includes a heating component 320 that requires the same electrical current to cause the heating component 320 to attain the required temperature to volatilize the aerosol precursor component 200), or may be determined by the controller 360/processor 370 upon engagement between the control body portion 120 and the cartridge body portion 140 (i.e., the cartridge portion 140 may include a processor (not shown) or other component such as a memory or other data repository capable of communicating and configured to communicate with the controller 360/processor 370 such that the controller 360/processor 370 can receive an indicia of the necessary electrical current therefrom). Upon the average power directed to the heating component being determined and initiated, the processor 370 may also commensurately initiate a heating time period. In some instances, the required average power may be determined upon actuation by the user (i.e., by way of a puff), which may include, for instance, communication between the controller 360/processor 370 and the processor and/or memory associated with the cartridge body portion 140 for an on-demand determination of the required average power (i.e., in response to the characteristics of the particular puff). That is, in some instances, a desired or otherwise predetermined "set point" for the power source 340 with respect to the heating component 320 may be included or otherwise associated with the heating component 320/cartridge body portion 140, and communicated to the controller 360/processor 370 associated with the control body portion 120 upon engagement between the control body portion 120 and the cartridge body portion 140 and subsequent puff initiation by the user. As such, different power set points and/or power profiles may be associated with different cartridge body portion types, arrangements, etc., as will be appreciated by one skilled in the art.

In some aspects, the average power directed to the heating component 320 may be sufficient to maintain the temperature required to volatilize the aerosol precursor component 200 for the duration of the heating time period (i.e., the heating time period which may end or expire, for example, upon the user de-actuating the pushbutton, ceasing the draw required to actuate the puff sensor, or otherwise indicating that the volatilized aerosol precursor component is no longer desired). In other instances, however, the controller 360/processor 370 may also be configured to monitor the heating component 320, to determine whether the heating component 320 is maintaining the temperature required to volatilize the aerosol precursor component 200, over the duration of the heating time period and to adjust the average power (increase or decrease), as necessary or desired, to maintain at least the required temperature of the heating component 320. For example, in some aspects, the required temperature may be substantially constant throughout the heating time period and, in such instances, the average power may be adjusted to maintain the required temperature or to maintain the temperature of the heating component within a range of temperatures about the required temperature. However, in other aspects, the required temperature may not necessarily be constant throughout the duration of the heating time period and, in such instances, the average power may be adjusted (i.e., ramped, cycled, pulsed, etc.) such that the temperature of the heating component 320 varies according to a temperature profile extending over the duration of the heating time period.

In order to implement the monitoring of the heating component 320 and adjusting the average power directed thereto, the controller 360/processor 370 may be configured to determine an actual power directed to the heating component 320, as a product of a voltage at the heating component 320 and a current through the heating component 320. That is, in some aspects, the controller 360/processor 370 may be configured to determine a voltage drop across the heating component 320. In other aspects, the controller 360/processor 370 may be configured to determine a voltage at the heating component 320 by comparing an actual voltage at the heating component 320 to a reference voltage (i.e., a reference voltage internal to or otherwise associated with the controller 360/processor 370). In some such aspects, the actual voltage at the heating component 320 may be between about 2.0 V and about 4.2 V (i.e., a voltage associated with the power source 340). In other such aspects, the internal reference voltage of the controller 360/processor 370 may be appropriately set so as to allow the actual voltage to be compared to the reference voltage, and the controller 360/processor 370 may be further configured to apply a voltage divider 400 to the actual voltage, and then compare the divided voltage (i.e., the actual voltage subjected to the voltage divider, or otherwise a representation of an input voltage to the heating component 320) to the internal reference voltage. In instances, for example, where the actual voltage at the heating device is between a low value of about 2.0 V and a high value of about 4.2 V, the divided voltage may also have low and high values corresponding to the low and high values of the actual voltage, and the internal reference voltage is appropriately set to a value greater than the high value of the divided voltage.

In some aspects, the voltage divider 400 may comprise, for example, two resistors in series, configured to use the input (actual) voltage at the heating component 320 to form a low voltage signal proportional to the reference voltage. The controller 360/processor 370 may be further configured to be in communication with the voltage divider 400 to receive the divided voltage therefrom, wherein the divided voltage 460 is the actual voltage at the heating component 320 multiplied by a ratio of a second resistor 440 to a sum of a first resistor 420 and the second resistor 440, and wherein the first and second resistors are the serially connected resistors forming the voltage divider 400. In some particular aspects, the voltage divider 400 may comprise, for example, a first resistor 420 having a resistance of between about 500 kOhm and about 1000 kOhm, and a second resistor 440 having a resistance of between about 100 kOhm and about 500 kOhm. As such, an actual voltage at the heating component 320 of between about 2.0 V and about 4.2 V, can produce a divided voltage 460 of between about 0.4 V and about 0.84 V for proportional comparison to the appropriately-set reference voltage. In some aspects, it may not be necessary to use the particular resistor values specified in the provided example, as long as, for instance, the first resistor 420 and the second resistor 440 have a resistance ratio therebetween of between about 1:1 and about 10:1, or otherwise to provide a divided voltage range appropriate for comparison to the reference voltage. In some particular aspects, it may be desirable for the first resistor 420 and the second resistor 440 to have a resistance ratio therebetween about 5:1. In yet other aspects, the first resistor and the second resistor of the voltage divider may be configured to have a resistance ratio therebetween corresponding to a ratio of the internal reference voltage of the controller 360/processor 370, to the high value of the range of the divided voltage. In one particular aspect, the controller 360/processor 370 may include a voltage ADC block 525 (i.e., a 10-bit successive approximation analog to digital converter), configured to implement the internal reference voltage of the controller 360/processor 370.

In still further aspects, the controller 360/processor 370 may also be configured to determine a current flow 550 (i.e., a differential current) through the heating component 320, for example, by determining a voltage drop across a resistor 575 serially disposed between the heating component 320 and the power source 340. More particularly, a current sensing arrangement may implement a specialized internal functional block of the controller 360/processor 370, for measuring a differential voltage between two separate ADC inputs. Since the value of the current sense arrangement (i.e., a resistor) may contribute to the overall system power loss, it may be important that the resistance of the selected resistor be relatively low. In one particular aspect, the resistance of the resistor 575 in the current sensing arrangement may be, for example, 0.02 ohms. The differential ADC 590 measures the voltage drop across the resistor 575 and, since the resistance value of the resistor 575 is relatively low and the resulting voltage drop measurement could be relatively small, another specialized functional block of the controller 360/processor 370 may be implemented to scale the measured voltage drop value, for example, by up by 50 times. Using the equation V=I*R for the given example, the current sensing arrangement disclosed herein may produce a measurement range of between 0 and about 0.05V for currents of between 0 A and about 4 A, and this measurement range would be automatically multiplied by 50, to obtain a voltage which may then be compared to the internal reference voltage of the controller 360/processor 370. In one particular aspect, the current flow through the heating component 320 may be determined, for example, using a current sensing ADC block 590 of the controller 360/processor 370 (i.e., a 10-bit successive approximation analog to digital converter), configured to use a differential input, a gain stage, and the internal reference voltage of the controller 360/processor 370.

Once the controller 360/processor 370 has determined representations of the actual voltage and current to the heating component, the controller 360/processor 370 may be further configured to read the determined values from the two ADC inputs and determine an instantaneous "actual" power (I*V) (see, e.g., element 595 in FIG. 2) directed to the heating component 320. In some instances, such an "instantaneous" power measurement may be added to a moving window of values (i.e., other instantaneous power measurements) and then an average of the window may calculated, for example, according to the equation, $P_{avg}=P_{sample}\ P_{avg}^{-1}/\text{WindowSize}$. In some aspects, for example, the window size may be between about 20 and about 256 samples.

The controller 360/processor 370 may further be configured to then compare the actual power experienced by the heating component 320 to the average power (i.e., the selected power set point initiated via the controller 360/processor 370 and associated with the power source 340 via the switch device 380). Since the selected power set point may be initiated by the controller 360/processor 370, with respect to the same internal voltage reference, the comparison may be conducted, for example, via a comparator implemented via software, hardware, or a combination of software and hardware, associated with the controller 360/processor 370. Based, on the comparison, the controller 360/processor 370 may be further configured to adjust the average power (i.e., the selected power set point) directed to the heating component 320 so as to adjust or otherwise direct the actual power directed toward the heating component 320 toward the selected power set point (i.e., such that the power determined at the heating component 320 corresponds to the specified or otherwise desired power set point). One skilled in the art will appreciate that, based on the comparison, the selected power set point may stay the same, increase, or decrease, as appropriate. Because of the rapid heating that may be desirable for the heating component 320 in the particular application of an electronic smoking article, it can be useful to include current regulating components to (i) regulate current flow through the heating component 320 to, for example, control heating of a resistive element, and the temperature experienced thereby, and (ii) prevent overheating and degradation of the substrate or other component carrying the aerosol precursor component and/or other flavors or inhalable materials. As such, regulation of the power directed to the heating component 320 can involve, for example, the modulation of current flow through the heating component 320 to maintain the heating component 320 within a desired temperature range. In other instances, a current regulating component can function to stop current flow to the heating component 320 once a defined or pre-selected temperature has been achieved. In yet other instances, a current regulating component likewise can cycle the current to the heating component 320 off and on once a defined or pre-selected temperature has been achieved so as to maintain the defined or pre-selected temperature for a defined or pre-selected period of time. One skilled in the art will appreciate that such regulation may, in some aspects, be involved with the variation of the selected power set point by the controller 360/processor 370.

In additional aspects of the present disclosure, the controller 360/processor 370 may be further configured to periodically determine the actual power, to subsequently compare the actual power to the average power, and then to adjust the average power directed to the heating component 320, to direct the actual power toward the selected power set point, until expiration or cessation of the heating time period. That is, in one example, the controller 360/processor 370, upon initial demand for heating the heating component 320, may be configured to set the average power (i.e., the configured power set point) output by the power source 340 to the heating component 320. An algorithm is then entered until the expiration or cessation of the heating time period, wherein such an algorithm may, for example, automatically compensate for fluctuations and decay in power source (i.e., battery) voltage and/or inconsistencies in the resistance determined at the heating component 320, to maintain the specified or otherwise desired power delivery to the heating component throughout the heating time period. More particularly, (1) if $P_{ave}$ (the actual power determined at the heating component 320) is below the selected power set point (the average power), the MOSFET switch device 380 is turned on so as to allow current flow from the power source 340 to the heating component 320; (2) if $P_{ave}$ is above the selected power set point, the MOSFET switch device 380 is turned off so as to prevent current flow from the power source 340 to the heating component 320; and (3) steps 1 and 2 are repeated until expiration or cessation of the heating time period. More particularly, during the heating time period, the determination and calculation of the actual power at the heating component 320, the comparison of the actual power to the pre-selected power set point, and ON/OFF decisions for the switch device 380 to adjust the pre-selected power set point may be substantially continuously performed by the controller 360/processor 370 at a rate, for example, of between about 20 and 50 times per second, so as to ensure a more stable and accurate average power directed to and delivered at the heating component 320. In some instances, component tolerances and design tolerances in applications as disclosed herein may control and maintain the actual power to within about 1%-10% of the pre-selected power set point.

In some aspects, the arrangements disclosed herein may also be configured to determine faults or malfunctions associated with the electronic smoking article 100. For example, an actual voltage at the heating component 320 below the minimum value of the expected voltage range may be an indication that the power source 340 (i.e., battery) is low, discharged, or otherwise defective. In another example, no current flow through the heating component 320 may indicate that the heating component 320 is defective or that there is an improper or defective connection between the control body portion 120 and the cartridge portion 140. As such, in some aspects, the controller 360/processor 370 may be configured to recognize such conditions and notify the user of such fault conditions or malfunctions.

Figure 4:
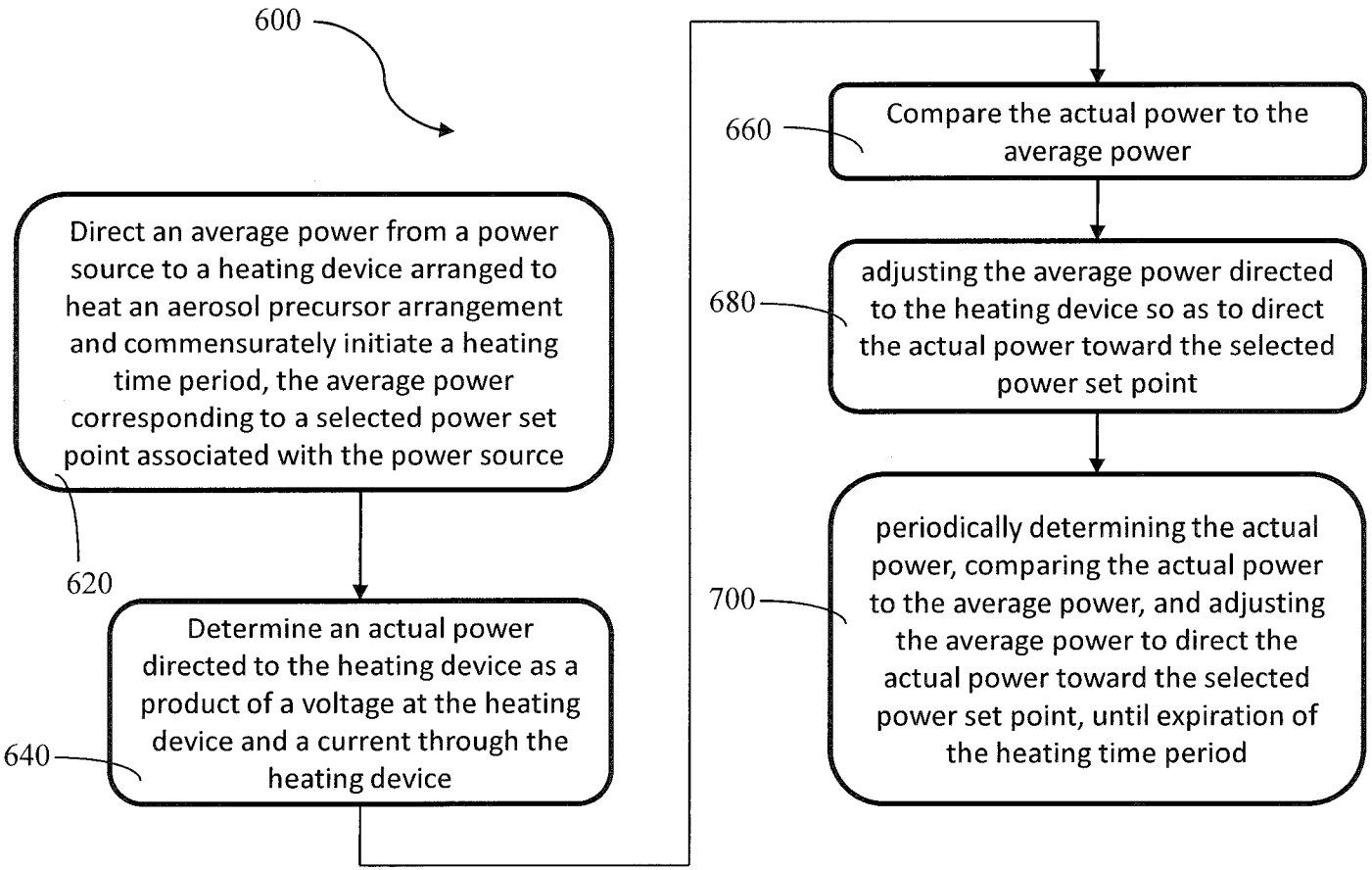
FIG. 4 is a schematic of a method of controlling heating of an aerosol precursor arrangement of an electronic smoking article, according to one aspect of the disclosure.

One skilled in the art will further appreciate that the arrangements associated with aspects of the present disclosure herein may also include method aspects associated therewith. For example, as shown in FIG. 4, such method aspects may include a method 600 of controlling heating of an aerosol precursor arrangement of an electronic smoking article, comprising: directing an average power from a power source to a heating device arranged to heat the aerosol precursor arrangement and commensurately initiating a heating time period, the average power corresponding to a selected power set point associated with the power source (block 620); determining an actual power directed to the heating device as a product of a voltage at the heating device and a current through the heating device (block 640); comparing the actual power to the average power (block 660); adjusting the average power directed to the heating device so as to direct the actual power toward the selected power set point (block 680); and periodically determining the actual power, comparing the actual power to the average power, and adjusting the average power to direct the actual power toward the selected power set point, until expiration of the heating time period (block 700)

In yet other aspects of the present disclosure, a computer program product is provided comprising at least one non-transitory computer readable storage medium having computer program code stored thereon. The program code of this embodiment may include program code for at least performing the steps of the method aspects upon execution thereof. That is, it will be understood that each block of the flowchart in FIG. 4, and/or combinations of blocks in the flowchart, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s), which may embody the procedures described herein, may be stored by one or more memory devices of the controller 360 or other suitable computing device and executed by the processor 370 associated with the controller 360 or other computing device. In some embodiments, the computer program instructions comprising the computer program product(s) which embody the procedures described above may be stored by memory devices of a plurality of computing devices. As will be appreciated, any such computer program product may be loaded onto a computer or other programmable apparatus to produce a machine, such that the computer program product including the instructions which execute on the computer or other programmable apparatus creates means for implementing the functions specified in the flowchart block(s). Further, the computer program product may comprise one or more computer-readable memories on which the computer program instructions may be stored such that the one or more computer-readable memories can direct a computer or other programmable apparatus or component to function in a particular manner, such that the computer program product comprises an article of manufacture which implements the function specified in the flowchart block(s). The computer program instructions of one or more computer program products may also be loaded onto a computer or other programmable apparatus or component to cause a series of operations to be performed on the computer or other programmable apparatus or component to produce a computer-implemented process such that the instructions which execute on the computer or other programmable apparatus implement the functions specified in the flowchart block(s). Accordingly, blocks of the flowchart support combinations of means for performing the specified functions. It will also be understood that one or more blocks of the flowchart, and combinations of blocks in the flowchart, may be implemented by special purpose hardware-based computer systems which perform the specified functions, or combinations of special purpose hardware and computer program product(s).

Figure 5:
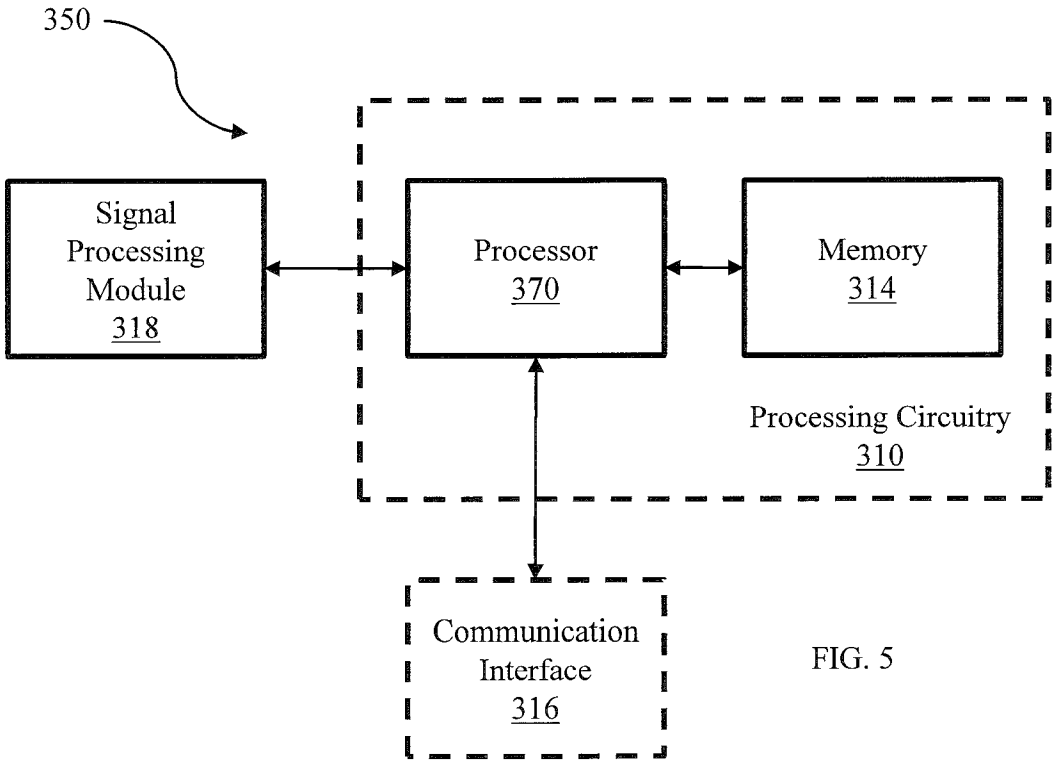
FIG. 5 is a block diagram of an apparatus that can be implemented on a computing device, according to one aspect of the disclosure.

In yet another aspect of the present disclosure, an apparatus comprising processing circuitry, or at least an appropriate processor 370, is provided. The processing circuitry of this example embodiment may be configured to control the apparatus to at least perform the steps of the method aspect. In this regard, FIG. 5 illustrates a block diagram of an apparatus 350 that can be implemented on a computing device in accordance with some example embodiments. In this regard, when implemented on a computing device, such as the controller 360, apparatus 350 can enable a computing device to operate within a system in accordance with one or more example embodiments. It will be appreciated that the components, devices or elements illustrated in and described with respect to FIG. 5 below may not be mandatory and thus some may be omitted in certain embodiments. Additionally, some embodiments can include further or different components, devices or elements beyond those illustrated in and described with respect to FIG. 5.

In some example embodiments, the apparatus 350 can include processing circuitry 310 that is configurable to perform actions in accordance with one or more example embodiments disclosed herein, such as method aspects previously disclosed. In this regard, the processing circuitry 310 can be configured to perform and/or control performance of one or more functionalities of the apparatus 350 in accordance with various example embodiments, and thus can provide means for performing functionalities of the apparatus 350 in accordance with various example embodiments. The processing circuitry 310 can be configured to perform data processing, application/software execution and/or other processing and management services according to one or more example embodiments.

In some embodiments, the apparatus 350 or a portion(s) or component(s) thereof, such as the processing circuitry 310, can include one or more chipsets, which can each include one or more chips. The processing circuitry 310 and/or one or more further components of the apparatus 350 can therefore, in some instances, be configured to implement an embodiment on a single chip or chipset. In some example embodiments in which one or more components of the apparatus 350 are embodied as a chipset, the chipset can be capable of enabling a computing device to operate in a system when implemented on or otherwise operably coupled to the computing device. Thus, for example, one or more components of the apparatus 350 can provide a chipset configured to enable a computing device to operate over a network.

In some example embodiments, the processing circuitry 310 can include a processor 370 and, in some embodiments, such as that illustrated in FIG. 5, can further include a memory 314. The processing circuitry 310 can be in communication with or otherwise control a communication interface (s) 316 and/or selection control module 318, as further disclosed herein. The processor 370 can be embodied in a variety of forms, as will be appreciated by one of ordinary skill in the art. For example, the processor 370 can be embodied as various processing means such as a microprocessor, a coprocessor, a controller or various other computing or processing devices including integrated circuits such as, for example, an application-specific integrated circuit (ASIC), a field-programmable gate array (FPGA), some combination thereof, or the like. Although illustrated as a single processor, it will be appreciated that the processor 370 can comprise a plurality of processors. The plurality of processors can be in operative communication with each other and can be collectively configured to perform one or more functionalities of the apparatus 300 as described herein. In some example embodiments, the processor 370 can be configured to execute instructions that can be stored in the memory 314 or that can be otherwise accessible to the processor 370. As such, whether configured by hardware or by a combination of hardware and software, the processor 370 is capable of performing operations according to various embodiments while configured accordingly.

In some example embodiments, the memory 314 can include one or more memory devices. The memory 314 can include fixed and/or removable memory devices. In some embodiments, the memory 314 can provide a non-transitory computer-readable storage medium that can store computer program instructions (i.e., software) that can be executed by the processor 370. In this regard, the memory 314 can be configured to store information, data, applications, instructions and/or the like for enabling the apparatus 350 to carry out various functions in accordance with one or more example embodiments, such as the method aspects disclosed herein. In some embodiments, the memory 314 can be in communication with one or more of the processor 370, communication interface(s) 316, or selection control module 318 via a bus(es) for passing information among components of the apparatus 350.

The apparatus 350 may further include a communication interface 316. The communication interface 316 may enable the apparatus 350 to receive a signal that may be sent by another computing device, such as over a network. In this regard, the communication interface 316 may include one or more interface mechanisms for enabling communication with other devices and/or networks. As such, the communication interface 316 may include, for example, an antenna (or multiple antennas) and supporting hardware and/or software for enabling communications with a wireless communication network (e.g., a cellular network, WLAN, and/or the like) and/or a communication modem or other hardware/software for supporting communication via cable, digital subscriber line (DSL), USB, FireWire, Ethernet or other wireline networking methods.

The apparatus 350 can further include selection control module 318. The selection control module 318 can be embodied as various means, such as circuitry, hardware, a computer program product comprising a computer readable medium (for example, the memory 314) storing computer readable program instructions and executable by a processing device (for example, the processor 370), or some combination thereof for performing particular operations or functions of aspects of the present disclosure, as otherwise disclosed herein. In some embodiments, the processor 370 (or the processing circuitry 310) can include, or otherwise control the selection control module 318.

Many modifications and other embodiments of the inventions set forth herein will come to mind to one skilled in the art to which these inventions pertain having the benefit of the teachings presented in the foregoing descriptions and the associated drawings. For example, the electronic smoking article 100 may be generally characterized as an e-cigarette device comprising two primary sub-components—a power/control unit and a cartridge unit—configured to be engaged/disengaged by a user, and capable of being separately manufactured. The power/control unit (or "control body portion") may include a battery, electronic controls, lights/LED's, and/or a pressure-activated switch. The electrical components of the power/control unit may be engaged with, for example, a flex circuit board that has wires from the battery soldered thereto. The housing of the power/control unit may be, for example, tubular and comprised of stainless steel, aluminum, etc. The cartridge unit (or "cartridge body portion") is configured to house the components necessary to generate an aerosol—for example, a heater wire wrapped around a wick, an "e-liquid", a flow tube, and "substrate" materials (i.e., fiber batting) to contain the e-liquid. In some instances, the wick is configured to be saturated with the e-liquid, and this e-liquid will vaporize when heated by current flowing through the heater wire. The cartridge unit may also include an authentication device (i.e., a Texas Instruments Model bq26150 authentication IC) to deter or prevent counterfeit cartridge units from being used with the power/control unit. An additional memory unit associated with the authentication device may be used to store a depletion amount of the cartridge unit, as well as to store other programmable features and information associated with the cartridge unit. The battery included with the power/control unit may be configured to be rechargeable, for example, via a USB charger. The cartridge unit may be "pre-filled" or otherwise include a particular amount of the e-liquid, which may or may not be refillable. The e-liquid (otherwise referred to herein, for example, as an aerosol precursor component) may be provided in various forms as otherwise disclosed herein.

The system design of the power/control unit and cartridge unit, as shown, for example, in FIG. 1, illustrates that the heating element of the cartridge unit may be represented, for instance, as a load resistor in the system block diagram. In addition, one example of functional operation of a representative electronic smoking article is disclosed herein. More particularly, in one configuration, the power/control unit (control body portion) may include, for example, a Microchip Model PIC18F14K50 Microcontroller (the controller 360/processor 370), a red LED 250, a white LED 260, a pressure switch 270 (i.e., a puff sensor), a MOSFET switch device 380, and a lithium polymer battery (power source 340).

The pressure switch 270 (puff sensor) is configured to be in communication with an integrated circuit (which may, in some instances, be included/associated with the controller 360/processor 370 or may be configured as a discrete unit with respect thereto), and arranged to detect a pressure differential across a membrane component thereof (i.e., a "puff" on the electronic smoking article 100 by a user). The pressure switch 270 is further configured to be responsive to the reaction of the membrane component to the pressure differential experienced thereby, and to output a voltage or other suitable signal. This voltage or other suitable signal output by the pressure switch 270 is directed to power up the controller 360/processor 370, for example, through a latch device 280, by actuating the main power supply to the controller 360/processor 370. The controller 360/processor 370 may then be configured to assert and output a "power hold" signal to the same latch device 280, which then allows the controller 360/processor 370 to continue to receive power from the main power supply, regardless of the future state of output of the pressure switch 270. The "power hold" signal may be asserted for a particular time period or until negated by a subsequent signal.

The controller 360/processor 370 may further be configured to subsequently query a security device associated with the cartridge unit (cartridge body portion), for example, to verify the liquid/e-liquid (aerosol precursor component) level associated therewith and/or the authenticity/compatibility (with the control body portion) of the cartridge unit (cartridge body portion). The controller 360/processor 370 may also be configured to check the battery (power source 340) voltage level to determine if minimum requirements are met. If allowed (i.e., if all checks are successful, for example, with suitable liquid level, authenticated cartridge unit, and sufficient power source level, the controller 360/processor 370 may be configured to then actuate the heating component 320 by actuating the MOSFET switch device 380.

During the puff (i.e., a user draw or series of draws on the electronic smoking article 100), the controller 360/processor 370 may be configured to monitor the input and/or output electrical parameters of the heating component 320 using a suitable power control arrangement, which may be implemented in software, hardware, or a combination of software and hardware. In one instance, the power control arrangement may be configured as software executable by the controller 360/processor 370, to optimize the heating performance of the heating component 320, for example, by modulating the output from the power source 340 using the MOSFET switch device 380. In such a manner, a substantially consistent power level (or, for example, a series of power levels following a heating profile) may be delivered to the heating component 320, as modulated using the MOSFET switch device 380, to therefore provide a substantially consistent vapor experienced by the user during a single puff, as well as across multiple puffs, even when the voltage at and provided by the power source 340 may be decaying.

In some aspects, the cartridge unit may include a memory device, wherein a desired or otherwise predetermined "set point" or "set point profile" for the power source 340 with respect to the heating component 320 may be stored in, included or otherwise associated with the memory device of the heating component 320/cartridge body portion 140/cartridge unit, and communicated to the controller 360/processor 370 associated with the power/control unit/control body portion 120 upon engagement between the control body portion 120 and the cartridge body portion 140. As such, different power set points and/or power profiles may be associated with different cartridge body portion types, arrangements, etc., as will be appreciated by one skilled in the art. In other aspects, heating component control parameters or power source regulation parameters may be programmed in the memory device, which can be used by the controller 360/processor 370 to (re)configure all or part of the power control algorithm/scheme for the heating component 320.

During each puff by the user, the controller 360/processor 370 may be configured to actuate the white LED 260 using, for example, a custom or predetermined actuation profile. The controller 360/processor 370 may also be configured to actuate a combination of the red and white LEDs 250, 260 to provide various indicators to the user (i.e., low battery, low liquid level, no authentication of the cartridge unit, etc) and, in doing so, may provide a "user interface" for interacting with the user. Such indicators may include, for example, continuous illumination, blinking, flashing, fade in/fade out, actuation/no actuation, or the like, or combinations thereof, as will be appreciated by one skilled in the art.

In some aspects, the power source 340 (i.e., battery) may be (re)chargeable. In such instances, the power source 340 may be charged or recharged, for example, via a connector 285 used to connect the power/control unit (control body portion 120) to the cartridge unit (cartridge portion 140) via a corresponding connector 290 associated with the cartridge unit. More particularly, the connector 285 may include conductors for connecting the power source 340 in the power/control unit to the heating component 320 in the cartridge unit. As such, in instances where the power source 340 comprises a rechargeable battery, such as a lithium ion battery, the same conductors associated with the connector 285 may be used to provide a charging current to the power source 340. With the controller 360/processor 370 powered off, a charger device may be connected to the power/control unit connector 285, wherein the charger device may be configured, for example, to direct a charging current/voltage through the MOSFET switch device 380 to allow the turn-on latch device 280 to power up the controller 360/processor 370. In some such aspects, the controller 360/processor 370 may be configured to monitor the charging process of the power source 340. At the end of the charging process, for example, the white LED may be illuminated to indicate that the charging process is complete.

One skilled in the art will appreciate that the operation/function of the exemplary aspects of the electronic smoking article disclosed herein may be accomplished and implemented via software, hardware, or a combination of software and hardware. If embodied in software, it will be understood that aspects of the electronic smoking article herein are not necessarily implemented as if the electronic smoking article were a state machine, and any "state" of the software and/or hardware mentioned herein does not necessarily correspond to any particular location or aspect in the aforementioned software. FIG. 6 schematically illustrates a flow of the operations/functions of the aspects of the electronic smoking article disclosed herein which, as discussed, may be implemented in software, hardware, or a combination of software and hardware.

With regard to the exemplary components of the aspects of the electronic smoking article disclosed herein, the controller 360/processor 370 (i.e., a Microchip Model PIC18F14K50) may include or otherwise have associated therewith a memory (i.e., 32 KB of program memory) for storing, for example, application software, a communications interface (i.e., a single-wire interface for communicating with the processor/memory associated with the cartridge unit or for communicating with another external fixture or element, such as an automated test/diagnosis fixture), data collection software, or the like. If a processor is included in the cartridge unit (i.e., a Texas Instruments Model bq26150 IC), that processor may include or otherwise have associated therewith a memory (i.e., 24K bits of memory) for storing, for instance, authentication information, compatibility data, feature data, serial numbers, and other appropriate data.

In regard to power/current consumption by the electronic smoking article, there may be four exemplary operating modes: OFF, ON, CHARGING and PUFFING. The OFF mode may be defined as instances where the controller 360/processor 370 is powered down, and is awaiting a signal from the puff sensor or other user interaction with the electronic smoking article indicating that the controller 360/processor 370 is required to be powered on. That is, in the OFF mode, there is no power supplied to the controller 360/processor 370. In the OFF mode, some current/power may be consumed by the pressure sensor device 270 and/or the required quiescent current of the power-on latch device 280. As such, in the OFF mode, the current/power consumption of the electronic smoking article may be at a minimum. In the ON mode, the controller 360/processor 370 is powered on and operational, and may be performing the following functions/operations:

- Red and white LEDs active for different "User Interface" indications
- Charging monitoring is in operation
- Communication operable via a data signal for factory notifications, or authentication of cartridge unit
- The power/control unit is powered on, but the heating component has not been enabled (by directing power thereto from the power source).

In the ON mode, the current/power consumption may be due, for example, to the current/power required by the LEDs, if the LEDs are powered on/actuated, wherein current in the ON mode may be about 20 mA or less.

During the CHARGING mode, the input charging voltage/current may be used to power on the controller 360/processor 370 and direct the MOSFET switch device to allow the charging voltage/current to be used by the (re)charge control circuit of the pressure sensor. Regulation of the current applied to the battery (power source) during the CHARGING mode may also be implemented by the (re)charge control circuit of the pressure sensor. In PUFFING mode, the MOSFET switch device may be actuated to direct current from the power source through the heating component. The PUFFING mode may be the highest current/power consumption mode, in both peak and average measures. Peak current in the PUFFING mode, as defined, for example, by the system components, may be up to about 4 A. Depending, for example, on battery charge level, the type or the cartridge unit, and the MOSFET switch device operational algorithm, the average power consumption may be between about 50% and 75% of the power consumption at peak current.

An algorithm may then be entered into until the expiration or cessation of the heating time period, wherein such an algorithm may, for example, automatically compensate for fluctuations and decay in power source (i.e., battery) voltage and/or inconsistencies in the resistance determined at the heating component 320, to maintain the specified or otherwise desired or constant power delivery to the heating component throughout the heating time period. More particularly, (1) if $P_{ave}$ (the actual power determined at the heating component 320) is below the selected power set point (the average power), the MOSFET switch device 380 is turned on so as to allow current flow from the power source 340 to the heating component 320; (2) if $P_{ave}$ is above the selected power set point, the MOSFET switch device 380 is turned off so as to prevent current flow from the power source 340 to the heating component 320; and (3) steps 1 and 2 are repeated until expiration or cessation of the heating time period. The heating time period may expire or cease, for example, upon the pressure sensor determining the end of a puff, or upon determination of the end of a "power hold" time period or signal. During heating time period, the measurement, calculation, and power ON/OFF determinations may be continuously performed by the controller 360/processor 370, for example, at a rate of between about 20 and about 50 times per second, to ensure stable and accurate average power delivered at the heating component.

FIG. 7 schematically illustrates an "area of stability" with respect to power control regulation according to various aspects of the disclosure. About the left end of the shaded area in the illustrated graph, below approximately 1 Ohm, the configuration may be impractical due to the peak currents required to be delivered from the power source (battery). About the right side of the shaded area, the current/power regulation may be effective to about 10 Ohms and greater, but delivering an average power higher than that shown by the graph's line may be limited due to the extent of the power available from the battery. FIG. 8 schematically illustrates a graph of one exemplary sample of power delivered to the heating component across battery voltage, with the target average power set to be constant.

Upon initiation of a puff by a user, the controller 360/processor 370 may be configured to set an output power target to a configured and specified set point (i.e., a default value hard-coded into the software). Prior to actuating the heating component, the controller 360/processor 370 may be configured to read several key parameters from the processor/memory of the cartridge unit and compare these parameters to the default parameters associated with the controller 360/processor 370. For example, three parameters may be read from the processor/memory of the cartridge unit, while the corresponding programmed default values for these parameters may be zero (0). As such, if a corresponding zero (0) is read by the controller 360/processor 370 for a parameter, the net result is that the particular cartridge unit does not require a corresponding parameter of the set point to change (i.e., "no change"). It follows that if any of the three parameters is other than zero (0), the heating component set point/set point profile for current/power is changed accordingly.

In one aspect, the programmable parameter values in the cartridge unit, when read by the power/control unit may completely replace the "standard" hard-coded default set point/set point profile. Further, additional/replacement offsets of these set points may then be applied instead, if so indicated by the cartridge unit. For example, in some instances, the programmable set of parameter values may divide a puff into 10 time-based segments, wherein each segment can have one of four different power set point offsets with respect to the default parameter for that time segment. Not all time segments are required to be used (i.e., to have value different from the default parameter value for that time segment, or even have a power level associated with that time segment). Using these time segments, a custom current/power profile for the heating component can be configured over the duration of the puff, as shown, for instance, in FIG. 9. In one particular example, the controller 360/processor 370 may be configured to direct a substantially constant current/power level from the power source 340 to the heating component 320. In such instances, the offset may be expressed as a percentage of the substantially current/power level. Further, in light of the 10 time segments, each segment may be assigned a representative equal time duration (i.e., 10 or 100). FIG. 9 schematically illustrates three examples of such customized current/power profiles for the heating component.

Such a heating component profile may thus be applied by the controller 360/processor 370 when actuated by a puff. Such a set of offsets forming the heating component profile may allow for irregularities in the heating component and/or the aerosol precursor component as the initial power is applied and e-liquid is atomized to form the aerosol. Such a heating component profile using the disclosed offset capability may also be used to create alternate sensory experiences, even from the same e-liquid chemistry (i.e., different heating component profiles may provide different characteristics with respect to the aerosol produced). In addition, the heating component profile may be programmable by the user of the electronic smoking article, the manufacturer, or automatically according to the type or identity of the detected cartridge unit. For example, the controller 360/processor 370 may include different heating component profiles each corresponding to a particular type of cartridge unit and/or the heating component utilized thereby. As such, upon determining the type of cartridge unit engaged with the power/control unit and/or the heating component used by the cartridge unit, the controller 360/processor 370 may retrieve the particular heating component profile corresponding thereto and actuate the same in response to a puff.

In another example, there may be four sets of numbers called puff segment offsets defined in the configuration data. Each of the four sets may include two values: a puff duration, and an offset. The puff duration may be configured to determine at what point (in milliseconds) the segment offset takes effect over the course of a single puff (maximum of 4 seconds). The offset may be configured to define what adjustment with respect to the target current/power is made when the specified puff duration has been reached. One intent of puff segment offsets is to allow more or less TPM (power) to be delivered at the beginning, middle, or end of a puff, or to remove such inconsistencies by accounting for irregularities due to, for instance, more e-liquid being present and vaporized at the beginning of a puff than toward the end of the puff. Another possible usage is to set the power target higher for a short time at the beginning of a puff to create more vapor initially. For example, specified puff segments may be as follows:

Segment 1: 0 duration, 2000 offset
Segment 2: 250 duration, 0 offset
Segment 3: 1500 duration, 1000 offset
Segment 4: 2500 duration, 1500 offset In this example, power to the heating component may be "kick-started" by the first segment for a quarter second, and then reverts to normal power in the second segment. After 1.5 seconds of puffing, the power is increased slightly by the third segment, perhaps to account for the wick running dry. Finally, after another second of puffing, the power is increased further in the 4th segment.

Each cartridge unit may, in some aspects, be characterized as having a "puff life" (i.e., measured in operational time) or maximum puff count or capacity. Accordingly, one skilled in the art will appreciate that different segments of the puff life or the puff count may be associated, by the power/control unit, with different heating component profiles, as previously discussed (see, e.g., FIG. 10). That is, a programmable set of, for example, ten segments, with each segment having a current/power offset or offset profile, may be applied over the puff life or puff count of the cartridge unit. Such an arrangement may, for example, be configured according to the characteristics of the e-liquid, as the e-liquid is consumed over the service life of the cartridge unit. In some aspects, programmable memory locations may be set up as ten 60-second segments which are applied from the end-of cartridge (maximum puff count) back toward the start of the cartridge when new (i.e., toward zero (0) puff count). If the puff count/puff life is greater than 600 (ten times 60 seconds), then the very first segment (initial puffs/beginning of a new cartridge unit) may be longer in duration to serially accommodate the next nine 60-second segments/increments over the remaining puff life. In some instances, the configuration data may include ten (10) cartridge life offsets, with each offset being activated under a particular range of remaining cartridge life, as defined by a Puff Count parameter. Each segment of cartridge life may be, for example, between about 30,000 and about 200,000 milliseconds of "puff time" (time that the heating component is powered on). An exemplary association between remaining Puff Count and offset index is shown in Table 1:

TABLE 1

| | Offset Index | | | | | | | | | |
|---|---|---|---|---|---|---|---|---|---|---|
| | 0 | 1 | 2 | 3 | 4 | 5 | 6 | 7 | 8 | 9 |
| Puff Time Left | 232 s to 589.8 s | 589.8 s to 524.2 s | 524.2 s to 458.7 s | 458.7 s to 393.2 s | 393.2 s to 327.7 s | 327.7 s to 262.1 s | 262.1 s to 196.6 s | 196.6 s to 131.1 s | 131.1 s to 65.6 s | 65.6 s to 0.0 s |

One purpose of cartridge life offsets may be to account for potential differences in how much vapor (TPM) is produced as the available e-liquid in the cartridge unit is deplete. One exemplary likely use case is that cartridge life offsets are 0 for most of the service life of the cartridge unit (i.e., 5 or more puff minutes remaining), and each offset gradually increases the target power as the cartridge unit gets closer to expiry.

FIG. 11 schematically illustrates one aspect of the Power On function for the controller 360/processor 370, including a logic gate ("OR") that supplies power to the controller 360/processor 370 and has two inputs, either of which can hold the gate on. One of the inputs may be connected to the pressure sensor, which powers up the controller 360/processor 370 when a pressure drop is detected by the pressure sensor. The second input may be controlled, for example, by the controller 360/processor 370 itself, in order to "hold" power on until the controller 360/processor 370, and not the pressure sensor, determines that it is acceptable to power down/off. Once the controller 360/processor 370 is powered up by the pressure sensor or charging circuit, the controller 360/processor 370 may immediately assert its own "power hold" output in order the latch the system in the ON (powered up) state.

FIG. 12 schematically illustrates aspects of the pressure sensor function, which may be implemented using, for example, a component device from Weifang Qinyi in China, though any other suitable device having the functionality and desirable aspects, as disclosed herein, may also be implemented. "K1" is a membrane switch of the device and "L1" represents the heating component/power source system/controller 360/processor 370 in an electronic smoking article design. The output to L1 is used to turn on and supply power to the controller 360/processor 370, which further controls the power source output to the heating component using the separate and discrete MOSFET switch device.

The pressure sensor switching mechanism (K1) may be comprised of, for example, basic components of a microphone, including a capacitive membrane coupled to a detection circuit, wherein the output from this switching mechanism is directed into the IC circuit. In some aspects, the IC may be configured to perform some amount of debounce (i.e., to eliminate jittering of the switch mechanism activity) of the switched input to provide a cleaner digital output at the "AT" port used for the power-on circuit of the system.

In some aspects, the IC shown in FIG. 12 may also be configured to perform battery protection functions since it is able to detect the battery input, loads on the battery terminals, as well as charging input. Such functions associated with battery protection may be, for example:

Short circuit protection

Under voltage lock out

Over-temperature protection.

In other aspects, the IC shown in FIG. 12 may also be configured to perform battery charging functions since it is able to detect the battery input, loads on the battery terminals, as well as charging input. Such functions associated with battery charging may be, for example:

Charging voltage: 4.5-6V

Measurement error for charging voltage: within 1%

Trickle charge mode when battery voltage is lower than 2.7V

Quick charge mode when battery voltage is between 2.7V and 4.2V

Constant voltage charging at 4.2V

The battery charging functions may be implemented in conjunction with and/or through the pressure sensor component as previously discussed. As also previously disclosed, the user interface of the electronic smoking article may include a red and a white LED, each characterized for luminosity over battery voltage, and having a PWM power algorithm implemented with respect thereto to provide the appearance of approximately the same intensity over a battery voltage range of about 3.5-4.2V. In this regard, the user interface software may be configured to monitor the charging current and then light the white LED indicating charge complete.

In other aspects, various functions may be implemented in software, hardware, or a combination of software and hardware. For example, in the event that the user, a device malfunction, or other inadvertent mechanism causes the electronic smoking article to attempt to puff continuously, the software may be configured to determine such a condition and terminate the puff automatically after a certain time period, such as 4 seconds. In some instances, the software may be configured to determine if the LED fade-out has not yet completed ramp-down and, if so, the puff will restart immediately and the fade-in of the LED will begin at the dimmed level that it was previously during fade-out. Further, in the event that the user, a device malfunction, or an inadvertent mechanism causes repeated puffing to occur, at each occurrence prior to the completion of the fade-out of the LED, the software may be configured to prevent additional puffs from activating the heating component once the cumulative repeated puff count exceeds, for example, 8 seconds. This lockout condition may be cleared once the LED is allowed to fully complete fade-out. Still further, a hardware-based watchdog timer may be provided that will automatically reset (and power down if there is no continuous puffing occurring) the system if the software becomes unstable and does not service the timer within the appropriate time interval of 8 seconds.

At the initiation of every puff, the software executed by the controller 360/processor 370 may be configured to communicate with the cartridge unit to conduct the authentication process to validate the cartridge unit as being a legitimate device for use with the power/control unit. If the cartridge unit is determined to be invalid, an error condition may be shown via the user interface LEDs. If the cartridge unit is authenticated, the puffing process is allowed to continue. At the start of every puff, following the authentication process, the software may also be configured to read puff count data from the cartridge unit memory and, if there are a sufficient number of "puff-seconds" (i.e., remaining capacity or service life) remaining, the software may be configured to allow actuation of the heating component. Upon a puff deactivation, the software may be configured to direct the white LED to flash 3 times in the sequence 100 mS on-500 mS off, when a low cartridge parameter/condition is detected, namely, starting with 20 3-second puffs estimated remaining, after the normal puff, the WHITE LED may be directed to flash three times, only every 15 puff-seconds; while starting at 5 3-second puffs estimated remaining, after the normal puff, the WHITE LED may be directed to flash three times, on every puff. The white LED may be directed to flash 5 times in the sequence 100 mS on-500 mS off, on every puff, when the cartridge unit is expired, and the heating component is not activated.

In some aspects, the software may be configured to direct certain battery management functions. For example, in the event that a low battery condition is determined, the software may be configured, upon a puff deactivation, to direct the red LED to flash 3 times in the sequence 100 mS on-500 mS off when the low battery condition is determined, namely, starting with 30 3-second puffs estimated remaining, after the normal puff, the RED LED is directed to flash three times, only every 15 puff-seconds; and starting at 10 3-second puffs estimated remaining, after the normal puff, the RED LED is directed to flash three times, on every puff.

As disclosed herein charging of the power source occurs when a voltage is detected at the connector configured to engage the cartridge unit. In response to the detected voltage, the MOSFET switch device is actuated, and the user interface LED activity is conducted as disclosed herein. During charging, the software may be configured to monitor the current being delivered to the battery. Upon reaching a full charge, the white LED is illuminated to indicate that charging is completed.

Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

That which is claimed:

1. A method of controlling heating of an aerosol precursor arrangement of an electronic smoking article, comprising:

directing power from a power source to turn a heating device on to heat the aerosol precursor arrangement and commensurately initiating a heating time period; and at a periodic rate until expiration of the heating time period, determining a moving window of measurements of instantaneous actual power directed to the heating device, each measurement of the window of measurements being determined as a product of a voltage at the heating device and a current through the heating device;

calculating a simple moving average power directed to the heating device based on the moving window of measurements a instantaneous actual power;

comparing the simple moving average power to a selected power set point associated with the power source; and adjusting the power directed from the power source to turn the heating device off or on at the periodic rate at each instance in which the simple moving average power is respectively above or below the selected power set point.

2. A method according to claim 1, wherein initiating a heating time period by directing power from a power source to a heating device, further comprises actuating a switch device, in electrical communication between the power source and the heating device, to direct an electrical current flow from the power source to the heating device.

3. A method according to claim 1, further comprising determining a voltage at the heating device by comparing an actual voltage at the heating device to a reference voltage.

4. A method according to claim 3, wherein the actual voltage at the heating device is between a low value of about 2.0 V and a high value of about 4.2 V, and comparing an actual voltage at the heating device to a reference voltage further comprises applying a voltage divider to the actual voltage and comparing the divided voltage to an internal reference voltage of a processor, the divided voltage having low and high values corresponding to the low and high values of the actual voltage.

5. A method according to claim 4, wherein comparing the divided voltage to an internal reference voltage of a processor further comprises comparing the divided voltage to an internal reference voltage greater than the high value of the divided voltage.

6. A method according to claim 4, wherein applying a voltage divider further comprises multiplying the actual voltage at the heating device by a ratio of a second resistor to a sum of a first resistor and the second resistor.

7. A method according to claim 6, wherein applying a voltage divider further comprises applying a voltage divider comprising a first resistor of between about 500 kOhm and about 1000 kOhm, and a second resistor of between about 100 kOhm and about 500 kOhm.

8. A method according to claim 6, wherein applying a voltage divider further comprises applying a voltage divider comprising a first resistor and a second resistor, having a resistance ratio therebetween of between about 1:1 and about 10:1.

9. A method according to claim 6, wherein applying a voltage divider further comprises applying a voltage divider comprising a first resistor and a second resistor, having a resistance ratio therebetween of about 5:1.

10. A method according to claim 6, wherein applying a voltage divider further comprises applying a voltage divider comprising a first resistor and a second resistor, having a resistance ratio therebetween corresponding to a ratio of the internal reference voltage of the processor to the high value of the divided voltage.

11. A method according to claim 4, wherein applying a voltage divider further comprises applying a voltage divider to the actual voltage so as to form a representation of an input voltage to a voltage analog-to-digital converter of a processor.

12. A method according to claim 1, further comprising determining a current through the heating device by determining a voltage drop across a resistor serially disposed between the heating device and the power source.

13. A heating-control apparatus for an aerosol precursor arrangement of an electronic smoking article, comprising:

a heating device arranged to heat the aerosol precursor arrangement;

a power source in communication with the heating device; and a controller in communication with the heating device and the power source, the controller having a processor configured to at least:

direct the power source to provide power to turn the heating device on and commensurately initiate a heating time period; and at a periodic rate until expiration of the beating time period, determine a moving window of measurements of instantaneous actual power directed to the heating device, each measurement of the window of measurements being determined as a product of a voltage at the heating device and a current through the heating device;

calculate a simple moving average power directed to the heating device based on the moving window of measurements of instantaneous actual power;

compare the simple moving average power to a selected power set point associated with the power source; and adjust the power directed from the power source to turn the heating device off or on at the periodic rate at each instance in which the simple moving average power is respectively above or below the selected power set point.

14. An apparatus according to claim 13, wherein the controller is further configured to actuate a switch device, in electrical communication between the power source and the heating device, to direct an electrical current flow from the power source to the heating device.

15. An apparatus according to claim 13, wherein the controller is further configured to determine a voltage at the heating device by comparing an actual voltage at the heating device to a reference voltage.

16. An apparatus according to claim 15, wherein the actual voltage at the heating device is between a low value of about 2.0 V and a high value of about 4.2 V, and wherein the controller is further configured to apply a voltage divider to the actual voltage and compare the divided voltage to an internal reference voltage of the processor, the divided voltage having low and high values corresponding to the low and high values of the actual voltage.

17. An apparatus according to claim 16, wherein the controller is further configured to compare the divided voltage to an internal reference voltage greater than the high value of the divided voltage.

18. An apparatus according to claim 16, wherein the controller is further configured to multiply the actual voltage at the heating device by a ratio of a second resistor to a sum of a first resistor and the second resistor.

19. An apparatus according to claim 18, wherein the controller is further configured to apply a voltage divider comprising a first resistor of between about 500 kOhm and about 1000 kOhm, and a second resistor of between about 100 kOhm and about 500 kOhm.

20. An apparatus according to claim 18, wherein the controller is further configured to apply a voltage divider comprising a first resistor and a second resistor, having a resistance ratio therebetween of between about 1:1 and about 10:1.

21. An apparatus according to claim 18, wherein the controller is further configured to apply a voltage divider comprising a first resistor and a second resistor, having a resistance ratio therebetween of about 5:1.

22. An apparatus according to claim 18, wherein the controller is further configured to apply a voltage divider comprising a first resistor and a second resistor, having a resistance ratio therebetween corresponding to a ratio of the internal reference voltage of the processor to the high value of the divided voltage.

23. An apparatus according to claim 18, wherein the controller is further configured to apply a voltage divider to the actual voltage so as to form a representation of an input voltage to a voltage analog-to-digital converter of the processor.

24. An apparatus according to claim 13, wherein the controller is further configured to determine a current through the heating device by determining a voltage drop across a resistor serially disposed between the heating device and the power source.

25. At least one non-transitory computer readable storage medium having computer program code stored thereon for controlling heating of an aerosol precursor arrangement of an electronic smoking article, the computer program code comprising:

program code for directing power from a power source to turn a heating device on to heat the aerosol precursor arrangement and commensurately initiating a heating time period; and at a periodic rate until expiration of the heating time period, program code for determining a moving window of measurements of instantaneous actual power directed to the heating device, each measurement of the window of measurements being determined as a product of a voltage at the heating device and a current through the heating device;

program code for calculating a simple moving average power directed to the heating device based on the moving window of measurements of instantaneous actual power;

program code for comparing the simple moving average power to a selected power set point associated with the power source; and program code for adjusting the power directed from the power source to turn the heating device off or on at the periodic rate at each instance in which the simple moving average power is respectively above or below the selected power set point.

26. At least one non-transitory computer readable storage medium according to claim 25, wherein the program code for initiating a heating time period by directing power from a power source to a heating device, further comprises program code for actuating a switch device, in electrical communication between the power source and the heating device, to direct an electrical current flow from the power source to the heating device.

27. At least one non-transitory computer readable storage medium according to claim 25, further comprising program code for determining a voltage at the heating device by comparing an actual voltage at the heating device to a reference voltage.

28. At least one non-transitory computer readable storage medium according to claim 26, wherein the actual voltage at the heating device is between a low value of about 2.0 V and a high value of about 4.2 V, and the program code for comparing an actual voltage at the heating device to a reference voltage further comprises program code for applying a voltage divider to the actual voltage and comparing the divided voltage to an internal reference voltage of a processor, the divided voltage having low and high values corresponding to the low and high values of the actual voltage.

29. A least one non-transitory computer readable storage medium according to claim 28, wherein the program code for comparing the divided voltage to an internal reference voltage of a processor further comprises the program code for comparing the divided voltage to an internal reference voltage greater than the high value of the divided voltage.

30. At least one non-transitory computer readable storage medium according to claim 28, wherein the program code for applying a voltage divider further comprises program code for multiplying the actual voltage at the heating device by a ratio of a second resistor to a sum of a first resistor and the second resistor.

31. At least one non-transitory computer readable storage medium according to claim 30, wherein the program code for applying a voltage divider further comprises program code for applying a voltage divider comprising a first resistor and a second resistor, having a resistance ratio therebetween of between about 1:1 and about 10:1.

32. At least one non-transitory computer readable storage medium according to claim 30, wherein the program code for applying a voltage divider further comprises program code for applying a voltage divider comprising a first resistor and a second resistor, having a resistance ratio therebetween of between about 1:1 and about 10:1.

33. At least one non-transitory computer readable storage medium according to claim 30, wherein the program code for applying a voltage divider further comprises program code for applying a voltage divider comprising a first resistor and a second resistor, having a resistance ratio therebetween of about 5:1.

34. At least one non-transitory computer readable storage medium according to claim 30, wherein the program code for applying a voltage divider further comprises program code for applying a voltage divider comprising a first resistor and a second resistor, having a resistance ratio therebetween corresponding to a ratio of the internal reference voltage of the processor to the high value of the divided voltage.

35. At least one non-transitory computer readable storage medium according to claim 28, wherein the program code for applying a voltage divider further comprises program code for applying a voltage divider to the actual voltage so as to form a representation of an input voltage to a voltage analog-to-digital converter of a processor.

36. At least one non-transitory computer readable storage medium according to claim 25, further comprising program code for determining a current through the heating device by determining a voltage drop across a resistor serially disposed between the heating device and the power source.

* * * * *